US011428040B2

(12) United States Patent
Koskulics et al.

(10) Patent No.: US 11,428,040 B2
(45) Date of Patent: Aug. 30, 2022

(54) ELECTROSTATIC LATCHING STOP BAR FOR DYNAMIC SHADE, AND/OR ASSOCIATED METHODS

(71) Applicant: GUARDIAN GLASS, LLC, Auburn Hills, MI (US)

(72) Inventors: Jeffrey Koskulics, Auburn Hills, MI (US); Joshua Finch, Auburn Hills, MI (US); David Lawrence, Auburn Hills, MI (US)

(73) Assignee: GUARDIAN GLASS, LLC, Auburn Hills, MI (US)

( * ) Notice: Subject to any disclaimer, the term of this patent is extended or adjusted under 35 U.S.C. 154(b) by 21 days.

(21) Appl. No.: 17/138,528

(22) Filed: Dec. 30, 2020

(65) Prior Publication Data

US 2021/0238914 A1 Aug. 5, 2021

Related U.S. Application Data

(63) Continuation-in-part of application No. 16/779,927, filed on Feb. 3, 2020, and a continuation-in-part of application No. 16/947,014, filed on Jul. 15, 2020.

(51) Int. Cl.

| | |
|---|---|
| ***E06B 3/67*** | (2006.01) |
| ***E06B 9/42*** | (2006.01) |
| *E06B 9/24* | (2006.01) |

(52) U.S. Cl.

CPC ..... *E06B 3/6722* (2013.01); *E06B 9/42* (2013.01); *E06B 2009/2417* (2013.01)

(58) Field of Classification Search

CPC .. E06B 3/6722; E06B 9/42; E06B 2009/2417; E06B 2009/2447

(Continued)

(56) References Cited

U.S. PATENT DOCUMENTS

| | | | |
|---|---|---|---|
| 3,236,290 | A | 2/1966 | Lueder |
| 3,897,997 | A | 8/1975 | Kalt |

(Continued)

FOREIGN PATENT DOCUMENTS

| | | | |
|---|---|---|---|
| EP | 1241507 | A2 | 9/2002 |
| JP | 10-249278 | A | 9/1998 |

(Continued)

OTHER PUBLICATIONS

U.S. Appl. No. 16/947,014, filed Jul. 15, 2020, 38 Pages.

(Continued)

*Primary Examiner* — Beth A Stephan

(57) ABSTRACT

Certain example embodiments relate to electric, potentially-driven shades usable with insulating glass (IG) units, IG units including such shades, and/or associated methods. In such a unit, a dynamic shade is located between the substrates defining the IG unit, and is movable between retracted and extended positions. The dynamic shade includes on-glass layers including a transparent conductor and an insulator or dielectric film, as well as a shutter. The shutter includes a resilient polymer-based layer and a conductive layer. A first voltage is applied to the transparent conductors to cause the shutter to extend to a closed position, and a second voltage is applied to a stop to electrostatically hold the shutter in the closed position. The first and second voltage levels can be reduced once the shutter is extended to the closed position, the reduction to the first voltage level being greater than the reduction to the second voltage level.

31 Claims, 8 Drawing Sheets

(58) Field of Classification Search
USPC ..... 160/7
See application file for complete search history.

(56) References Cited

U.S. PATENT DOCUMENTS

| | | | |
|---|---|---|---|
| 3,989,357 | A | 11/1976 | Kalt |
| 4,094,590 | A | 6/1978 | Kalt |
| 4,105,294 | A | 8/1978 | Peck |
| 4,208,103 | A | 6/1980 | Kalt et al. |
| 4,248,501 | A | 2/1981 | Simpson |
| 4,266,339 | A | 5/1981 | Kalt |
| 4,336,536 | A | 6/1982 | Kalt et al. |
| 4,383,255 | A | 5/1983 | Grandjean et al. |
| 4,468,663 | A | 8/1984 | Kalt |
| 4,488,784 | A | 12/1984 | Kalt et al. |
| 4,695,837 | A | 9/1987 | Kalt |
| 4,747,670 | A | 5/1988 | Devio et al. |
| 4,788,089 | A | 11/1988 | Skipper |
| 4,915,486 | A | 4/1990 | Hansen |
| 4,978,952 | A | 12/1990 | Irwin |
| 5,231,559 | A | 7/1993 | Kalt et al. |
| 5,519,565 | A | 5/1996 | Kalt et al. |
| 5,554,434 | A | 9/1996 | Park et al. |
| 5,629,790 | A | 5/1997 | Neukermans et al. |
| 5,638,084 | A | 6/1997 | Kalt |
| 6,057,814 | A | 5/2000 | Kalt |
| 6,075,639 | A | 6/2000 | Kino et al. |
| 6,081,304 | A | 6/2000 | Kuriyama et al. |
| 6,229,509 | B1 | 5/2001 | DeLuca et al. |
| 6,317,108 | B1 | 11/2001 | Kalt |
| 6,557,279 | B2 | 5/2003 | Araki et al. |
| 6,692,646 | B2 | 2/2004 | Kalt et al. |
| 6,771,237 | B1 | 8/2004 | Kalt |
| 6,887,575 | B2 | 5/2005 | Neuman et al. |
| 6,897,786 | B1 | 5/2005 | Kalt et al. |
| 6,972,888 | B2 | 12/2005 | Poll et al. |
| 7,056,588 | B2 | 6/2006 | Neuman et al. |
| 7,085,609 | B2 | 8/2006 | Bechtel et al. |
| 7,189,458 | B2 | 3/2007 | Ferreira et al. |
| 7,198,851 | B2 | 4/2007 | Lemmer et al. |
| 7,645,977 | B2 | 1/2010 | Schlam et al. |
| 7,705,826 | B2 | 4/2010 | Kalt et al. |
| 7,771,830 | B2 | 8/2010 | Neuman et al. |
| 7,998,320 | B2 | 8/2011 | Laird et al. |
| 8,035,075 | B2 | 10/2011 | Schlam et al. |
| 8,134,112 | B2 | 3/2012 | Schlam et al. |
| 8,557,391 | B2 | 10/2013 | Frank et al. |
| 8,668,990 | B2 | 3/2014 | Broadway et al. |
| 8,736,938 | B1 | 5/2014 | Schlam et al. |
| 8,925,286 | B2 | 1/2015 | Hagen et al. |
| 8,982,441 | B2 | 3/2015 | Schlam et al. |
| 9,229,291 | B2 | 1/2016 | Kailasam et al. |
| 9,556,066 | B2 | 1/2017 | Frank et al. |
| 9,670,092 | B2 | 6/2017 | Lemmer et al. |
| 9,695,085 | B2 | 7/2017 | Lemmer et al. |
| 9,796,619 | B2 | 10/2017 | Broadway et al. |
| 9,802,860 | B2 | 10/2017 | Frank et al. |
| 10,162,240 | B2 | 12/2018 | Rozbicki |
| 10,288,969 | B2 | 5/2019 | Kailasam et al. |
| 10,788,723 | B2 | 9/2020 | Rozbicki et al. |
| 10,801,258 | B2 | 10/2020 | Krasnov et al. |
| 10,831,077 | B2 | 11/2020 | Kailasam et al. |
| 10,871,027 | B2 | 12/2020 | Petrmichl et al. |
| 10,876,349 | B2 | 12/2020 | Blush et al. |
| 10,895,102 | B2 | 1/2021 | Frey et al. |
| 10,914,114 | B2 | 2/2021 | Blush et al. |
| 10,927,592 | B2 | 2/2021 | Blush et al. |
| 2002/0144831 | A1 | 10/2002 | Kalt |
| 2010/0172007 | A1 | 7/2010 | Schlam et al. |
| 2013/0188235 | A1 | 7/2013 | Floyd |
| 2014/0272314 | A1 | 9/2014 | Veerasamy |
| 2014/0338846 | A1 | 11/2014 | Hikmet et al. |
| 2017/0184221 | A1 | 6/2017 | Mcnamara et al. |

FOREIGN PATENT DOCUMENTS

| | | | |
|---|---|---|---|
| JP | 2005089643 | A | 4/2005 |
| KR | 20090008928 | A | 1/2009 |
| KR | 20130011845 | A | 1/2013 |
| WO | 2018138015 | A1 | 8/2018 |
| WO | 2020008434 | A1 | 1/2020 |
| WO | 2020008438 | A1 | 1/2020 |

OTHER PUBLICATIONS

U.S. Appl. No. 16/779,990, filed Feb. 3, 2020; Yabei Gu.
U.S. Appl. No. 16/792,348, filed Feb. 17, 2020; Yabei Gu et al.
International Search Report and Written Opinion received for PCT Application No. PCT/IB2021/050870, dated May 19, 2021, 10 Pages.
International Search Report and Written Opinion received for PCT Application No. PCT/IB2021/062199, dated Apr. 20, 2022, 12 Pages.
"Linear Technology-Photoflash Capacitor Chargers LT3484-0/LT3484-1ILT3484-2", retrieved from Internet URL: https://www.analog.com/media/en/technical-documentation/data-sheets/3484012f.pdf, retrieved on Jun. 10, 2020, 12 pages.
International Search Report and Written Opinion received for PCT Application No. PCT/IB2021/050867, dated May 21, 2021, 10 Pages.
International Search Report and Written Opinion received for PCT Application No. PCT/IB2021/051326, dated May 27, 2021, 12 pages.
International Search Report and Written Opinion received for PCT Application No. PCT/IB2021/056376, dated Nov. 8, 2021, 10 Pages.
Notice of Allowance received for U.S. Appl. No. 16/779,990 , dated Aug. 6, 2021, 09 Pages.

ELECTROSTATIC LATCHING STOP BAR FOR DYNAMIC SHADE, AND/OR ASSOCIATED METHODS

CROSS-REFERENCE TO RELATED APPLICATION

This application is a continuation-in-part (CIP) of U.S. application Ser. No. 16/779,927 filed on Feb. 3, 2020 and a CIP of U.S. application Ser. No. 16/947,014 filed on Jul. 15, 2020, the entire contents of each of which are hereby incorporated herein by reference.

TECHNICAL FIELD

Certain example embodiments of this invention relate to shades that may be used with insulating glass units (IG units or IGUs), IG units including such shades, and/or methods of making the same. More particularly, certain example embodiments of this invention relate to electric, potentially-driven shades that may be used with IG units, IG units including such shades, and/or methods of making the same.

BACKGROUND AND SUMMARY

The building sector is known for its high energy consumption, which has been shown to represent 30-40% of the world's primary energy expenditure. Operational costs, such as heating, cooling, ventilation, and lighting account for the better part of this consumption, especially in older structures built under less stringent energy efficiency construction standards.

Windows, for example, provide natural light, fresh air, access, and connection to the outside world. However, they oftentimes also represent a significant source of wasted energy. With the growing trend in increasing the use of architectural windows, balancing the conflicting interests of energy efficiency and human comfort is becoming more and more important. Furthermore, concerns with global warming and carbon footprints are adding to the impetus for novel energy efficient glazing systems.

In this regard, because windows are usually the "weak link" in a building's isolation, and considering modern architectural designs that often include whole glass facades, it becomes apparent that having better insulating windows would be advantageous in terms of controlling and reducing energy waste. There are, therefore, significant advantages both environmentally and economically in developing highly insulating windows.

Insulating glass units (IG units or IGUs) have been developed and provide improved insulation to buildings and other structures, and FIG. 1 is a cross-sectional, schematic view of an example IG unit. In the FIG. 1 example IG unit, first and second substrates 102 and 104 are substantially parallel and spaced apart from one another. A spacer system 106 is provided at the periphery of the first and second substrates 102 and 104, helping to maintain them in substantially parallel spaced apart relation to one another and helping to define a gap or space 108 therebetween. The gap 108 may be at least partially filled with an inert gas (such as, for example, Ar, Kr, Xe, and/or the like) in some instances, e.g., to improve the insulating properties of the overall IG unit. Optional outer seals may be provided in addition to the spacer system 106 in some instances.

Windows are unique elements in most buildings in that they have the ability to "supply" energy to the building in the form of winter solar gain and daylight year around. Current window technology, however, often leads to excessive heating costs in winter, excessive cooling costs in summer, and often fails to capture the benefits of daylight, that would allow lights to be dimmed or turned off in much of the nation's commercial stock.

Thin film technology is one promising way of improving window performance. Thin films can, for example, be applied directly onto glass during production, on a polymer web that can be retrofitted to an already pre-existing window at correspondingly lower cost, etc. And advances have been made over the last two decades, primarily in reducing the U-value of windows through the use of static or "passive" low-emissivity (low-E) coatings, and by reducing the solar heat gain coefficient (SHGC) via the use of spectrally selective low-E coatings. Low-E coatings may, for example, be used in connection with IG units such as, for example, those shown in and described in connection with FIG. 1. However, further enhancements are still possible.

For instance, it will be appreciated that it would be desirable to provide a more dynamic IG unit option that takes into account the desire to provide improved insulation to buildings and the like, takes advantage of the ability of the sun to "supply" energy to its interior, and that also provides privacy in a more "on demand" manner. It will be appreciated that it would be desirable for such products to have a pleasing aesthetic appearance, as well.

Certain example embodiments address these and/or other concerns. For instance, certain example embodiments of this invention relate to electric, potentially-driven shades that may be used with IG units, IG units including such shades, and/or methods of making the same.

In certain example embodiments, an insulating glass (IG) unit is provided. First and second substrates each have interior and exterior major surfaces, the interior major surface of the first substrate facing the interior major surface of the second substrate. A spacer system helps to maintain the first and second substrates in substantially parallel spaced apart relation to one another and to define a gap therebetween. An anchor and a stop are provided, with at least a portion of the stop being electrically conductive. A dynamically controllable shade is interposed between the first and second substrates. The shade includes a first conductive layer provided, directly or indirectly, on the interior major surface of the first substrate; a first dielectric layer provided, directly or indirectly, on the first conductive layer on a side thereof opposite the first substrate; and a shutter including a flexible substrate supporting a second conductive layer, the shutter being extendible from the anchor towards the stop to a shutter closed position and being retractable from the stop towards the anchor to a shutter open position. A second dielectric layer is provided, directly or indirectly, on an anchor-facing surface of the stop. A control circuit is configured to provide: a first voltage to the first and second conductive layers to create first electrostatic forces to drive the flexible substrate to the shutter closed position; and a second voltage to the electrically conductive portion of the stop to create second electrostatic forces to help electrostatically latch the flexible substrate to the stop.

In certain example embodiments, there is provided a substrate comprising an anchor and a stop, at least a portion of the stop being electrically conductive. A dynamically controllable shade is provided thereon, the shade including: a first conductive layer provided, directly or indirectly, on the substrate; a first dielectric layer provided, directly or indirectly, on the first conductive layer on a side thereof opposite the substrate; and a shutter including a flexible substrate supporting a second conductive layer, the shutter being extendible from the anchor towards the stop to a shutter closed position and being retractable from the stop towards the anchor to a shutter open position. A second dielectric layer is provided, directly or indirectly, on an anchor-facing surface of the stop. The first and second conductive layer and the conductive portion of the stop are all connectable to a control circuit configured to provide: a first voltage to the first and second conductive layers to create first electrostatic forces to drive the flexible substrate to the shutter closed position; and a second voltage to the electrically conductive portion of the stop to create second electrostatic forces to help electrostatically latch the flexible substrate to the stop.

In certain example embodiments, a method of making an insulating glass (IG) unit is provided. The method comprises having first and second substrates, each having interior and exterior major surfaces, the interior major surface of the first substrate facing the interior major surface of the second substrate. An anchor and a stop are provided. At least a portion of the stop is electrically conductive. A second dielectric layer is provided, directly or indirectly, on an anchor-facing surface of the stop. A dynamically controllable shade is provided on the first and/or second substrate, the shade including: a first conductive layer provided, directly or indirectly, on the interior major surface of the first substrate; a first dielectric layer provided, directly or indirectly, on the first conductive layer on a side thereof opposite the first substrate; and a shutter including a flexible substrate supporting a second conductive layer, the shutter being extendible from the anchor towards the stop to a shutter closed position and being retractable from the stop towards the anchor to a shutter open position. The first and second conductive layer and the conductive portion of the stop are connected to a control circuit that is configured to provide (a) a first voltage to the first and second conductive layers to create first electrostatic forces to drive the flexible substrate to the shutter closed position, and (b) a second voltage to the electrically conductive portion of the stop to create second electrostatic forces to help electrostatically latch the flexible substrate to the stop. The first and second substrates are connected to one another in substantially parallel, spaced apart relation, such that a gap is defined therebetween and such that the dynamically controllable shade is located in the gap.

In certain example embodiments, a method of operating a dynamic shade in an insulating glass (IG) unit is provided. The method comprises having an IG unit made in accordance with the techniques disclosed herein; and selectively activating the power source to move the polymer substrate between the shutter open and closed positions.

The features, aspects, advantages, and example embodiments described herein may be combined to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION

Figure 1:
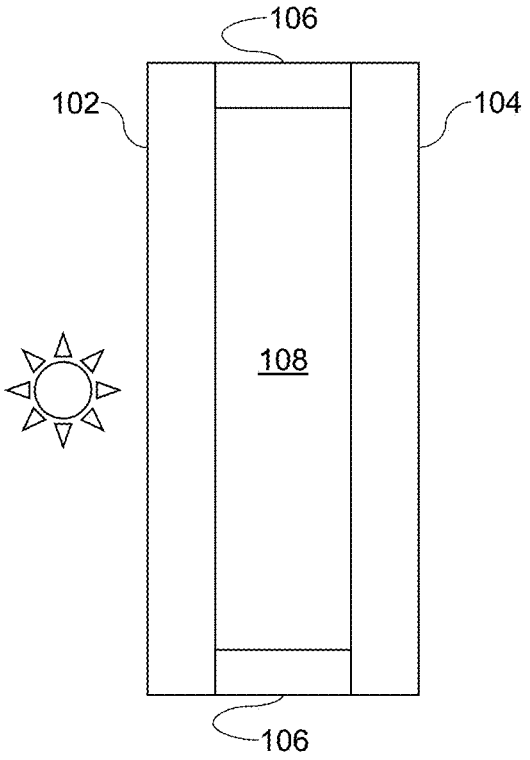
FIG. 1 is a cross-sectional, schematic view of an example insulating glass unit (IG unit or IGU)
Figure 2:
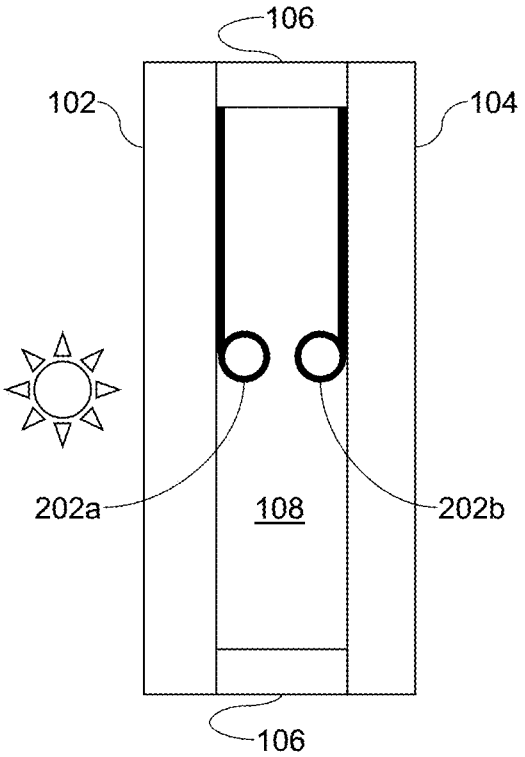
FIG. 2 is a cross-sectional, schematic view of an example IGU incorporating electric potentially-driven shades that may be used in connection with certain example embodiments.

Certain example embodiments of this invention relate to electric, potentially-driven shades that may be used with IG units, IG units including such shades, and/or methods of making the same. Referring now more particularly to the drawings, FIG. 2 is a cross-sectional, schematic view of an example insulating glass unit (IG unit or IGU) incorporating electric potentially-driven shades that may be used in connection with certain example embodiments. More specifically, FIG. 2 is similar to FIG. 1 in that first and second substantially parallel spaced apart glass substrates 102 and 104 are separated from one another using a spacer system 106, and a gap 108 is defined therebetween. First and second electric potentially-driven shades 202*a* and 202*b* are provided in the gap 108, proximate to inner major surfaces of the first and second substrates 102 and 104, respectively. As will become clearer from the description provided below, the shades 202*a* and 202*b* are controlled by the creation of an electric potential difference between the shades 202*a* and 202*b*, and conductive coatings formed on the inner surfaces of the substrates 102 and 104, respectively. As also will become clearer from the description provided below, each of shades 202*a* and 202*b* may be created using a polymer film coated with a conductive coating (e.g., a coating comprising a layer including Al, Cr, ITO, and/or the like). An aluminum-coated shade may provide for partial-to-complete reflection of visible light, and up to significant amounts of total solar energy.

The shades 202*a* and 202*b* are normally retracted (e.g., rolled up), but they rapidly extend (e.g., roll out) when an appropriate voltage is applied, in order to cover at least a portion of the substrates 102 and 104 much like, for example, a "traditional" window shade. The rolled-up shade may have a very small diameter, and typically will be much smaller than the width of the gap 108 between the first and second substrates 102 and 104, so that it can function between them and be essentially hidden from view when rolled up. The rolled-out shades 202*a* and 202*b* adhere strongly to their respective adjacent substrates 102 and 104.

The shades 202*a* and 202*b* extend along all or a portion of a vertical length of the visible or "framed" area of the substrates 102 and 104 from a retracted configuration to an extended configuration. In the retracted configuration, the shades 202*a* and 202*b* have a first surface area that substantially permits radiation transmission through the framed area. In the extended configuration, the shades 202*a* and 202*b* have a second surface area that substantially controls radiation transmission through the framed area. The shades 202*a* and 202*b* may have a width that extends across all or a portion of the horizontal width of the framed area of the substrates 102 and 104 to which they are attached.

Each of the shades 202*a* and 202*b* is disposed between the first and second substrates 102 and 104, and each preferably is attached at one end to an inner surface thereof (or a dielectric or other layer disposed thereon), near the tops thereof. An adhesive layer may be used in this regard. The shades 202*a* and 202*b* are shown partially rolled out (partially extended) in FIG. 2. The shades 202*a* and 202*b* and any adhesive layer or other mounting structure preferably are hidden from view so that the shades 202*a* and 202*b* are only seen when at least partially rolled out.

The diameter of a fully rolled-up shade preferably is about 1-5 mm but may be greater than 5 mm in certain example embodiments. Preferably, the diameter of a rolled-up shade is no greater than the width of the gap 108, which is typically about 10-25 mm (sometimes 10-15 mm), in order to help facilitate rapid and repeated roll-out and roll-up operations. Although two shades 202*a* and 202*b* are shown in the FIG. 2 example, it will be appreciated that only one shade may be provided in certain example embodiments, and it also will be appreciated that that one shade may be provided on an inner surface of either the inner or outer substrate 102 or 104. In example embodiments where there are two shades, the combined diameter thereof preferably is no greater than the width of the gap 108, e.g., to facilitate roll-out and roll-up operations of both shades.

An electronic controller may be provided to help drive the shades 202*a* and 202*b*. The electronic controller may be electrically connected to the shades 202*a* and 202*b*, as well as the substrates 102 and 104, e.g., via suitable leads or the like. The leads may be obscured from view through the assembled IG unit. The electronic controller is configured to provide an output voltage to the shades 202*a* and 202*b* with respect to the conductive layers in substrates 102 and 104, respectively. Output voltage in the range of about 100-600 V DC can be used for driving the shades 202*a* and 202*b* in certain example embodiments. An external AC or DC power supply, a DC battery, and/or the like may be used in this regard. It will be appreciated that higher or lower output voltage may be provided, e.g., depending on the fabrication parameters and materials that comprise the shades 202*a* and 202*b*, the layers on the substrates 102 and 104, etc.

The controller may be coupled to a manual switch, remote (e.g., wireless) control, or other input device, e.g., to indicate whether the shades 202*a* and 202*b* should be retracted or extended. In certain example embodiments, the electronic controller may include a processor operably coupled to a memory storing instructions for receiving and decoding control signals that, in turn, cause voltage to be selectively applied to control the extension and/or retraction of the shades 202*a* and 202*b*. Further instructions may be provided so that other functionality may be realized. For instance, a timer may be provided so that the shades 202*a* and 202*b* can be programmed to extend and retract at user-specified or other times, a temperature sensor may be provided so that the shades 202*a* and 202*b* can be programmed to extend and retract if user-specified indoor and/or outdoor temperatures are reached, light sensors may be provided so that the shades 202*a* and 202*b* can be programmed to extend and retract based on the amount of light outside of the structure, etc.

Although two shades 202*a* and 202*b* are shown in FIG. 2, as noted above, certain example embodiments may incorporate only a single shade. Furthermore, as noted above, such shades may be designed to extend vertically and horizontally along and across substantially the entire IG unit, different example embodiments may involve shades that cover only portions of the IG units in which they are disposed. In such cases, multiple shades may be provided to deliver more selectable coverage, to account for internal or external structures such as muntin bars, to simulate plantation shutters, etc. As another example, a first shade may cover a first part (e.g., top part or left/right part) of a window and a second shade may cover a second part (e.g., a bottom or right/left) of that window. As another example, first, second, and third shades may be provided to cover different approximate one-third portions of a given window.

In certain example embodiments, a locking restraint may be disposed at the bottom of the IGU, e.g., along some or all of its width, to help prevent the shades from rolling out their entire lengths. The locking restraint may be made from a conductive material, such as a metal or the like. The locking restraint also may be coated with a low dissipation factor polymer such as, for example, polypropylene, fluorinated ethylene propylene (FEP), polytetrafluoroethylene (PTFE), and/or the like.

Figure 3:
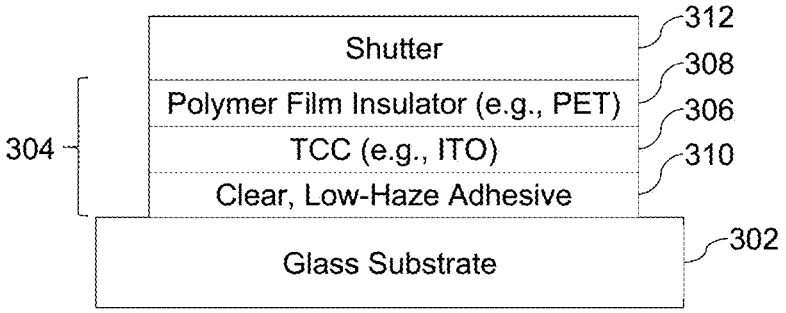
FIG. 3 is a cross-sectional view showing example on-glass components from the FIG. 2 example IGU that enable shutter action, in accordance with certain example embodiments.
Figure 4:
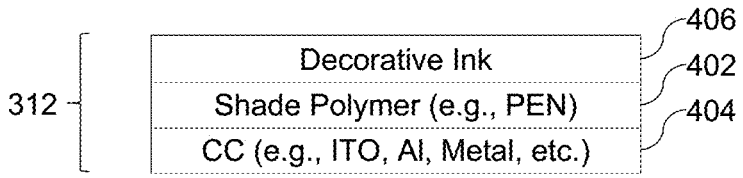
FIG. 4 is a cross-sectional view of an example shutter from the FIG. 2 example IGU, in accordance with certain example embodiments.

Example details of the operation of the shades 202*a* and 202*b* will now be provided in connection with FIGS. 3-4. More particularly, FIG. 3 is a cross-sectional view showing example "on-glass" components from the FIG. 2 example IGU that enable shutter action, in accordance with certain example embodiments; and FIG. 4 is a cross-sectional view of an example shutter from the FIG. 2 example IGU, in accordance with certain example embodiments. FIG. 3 shows a glass substrate 302, which may be used for either or both of the substrates 102 and 104 in FIG. 2. The glass substrate 302 supports on-glass components 304, as well as the shutter 312. In certain example embodiments, when unrolled, the conductor 404 may be closer to the substrate 302 than the ink layer 406. In other example embodiments, this arrangement may be reversed such that, for example, when unrolled, the conductor 404 may be farther from the substrate 302 than the ink layer 406.

The on-glass components 304 include a transparent conductor 306, along with a dielectric material 308, which may be adhered to the substrate 302 via a clear, low-haze adhesive 310 or the like. These materials preferably are substantially transparent. In certain example embodiments, the transparent conductor 306 is electrically connected via a terminal to a lead to the controller. In certain example embodiments, the transparent conductor 306 serves as a fixed electrode of a capacitor, and the dielectric material 308 serves as the dielectric of this capacitor. In such cases, a dielectric or insulator film is provided, directly or indirectly, on the first conductive layer, with the dielectric or insulator film being separate from the shutter.

It will be appreciated that it is possible to put all of the dielectric layers on the shade in certain example embodiments, thereby exposing a bare conductive (flat) substrate, e.g., a glass substrate supporting a conductive coating. For example, in certain example embodiments, the polymer film insulator 308 may be provided on/integrated as a part of the shutter 312, rather than being provided on/integrated as a part of the substrate 302. That is, the shutter 312 may further support a dielectric or insulator film 308 thereon such that, when the at least one polymer substrate is in the shutter closed position and the shutter is extended, the dielectric or insulator film directly physically contacts the first conductive layer with no other layers therebetween.

The transparent conductor 306 may be formed from any suitable material such as, for example, ITO, tin oxide (e.g., $SnO_2$ or other suitable stoichiometry), etc. The transparent conductor 306 may be 10-500 nm thick in certain example embodiments. The dielectric material 308 may be a low dissipation factor polymer in certain example embodiments. Suitable materials include, for example, polypropylene, FEP, PTFE, polyethylene terephthalate (PET), polyimide (PI), and polyethylene napthalate (PEN), etc. The dielectric material 308 may have a thickness of 1-30 microns (e.g., 4-25 microns) in certain example embodiments. The thickness of the dielectric material 308 may be selected so as to balance reliability of the shade with the amount of voltage (e.g., as thinner dielectric layers typically reduce reliability, whereas thicker dielectric layers typically require a higher applied voltage for operational purposes).

As is known, many low-emissivity (low-E) coatings are conductive. Thus, in certain example embodiments, a low-E coating may be used in place of the transparent conductor 306 in certain example embodiments. The low-E coating may be a silver-based low-E coating, e.g., where one, two, three, or more layers comprising Ag may be sandwiched between dielectric layers. In such cases, the need for the adhesive 310 may be reduced or completely eliminated.

The shutter 312 may include a resilient layer 402. In certain example embodiments, a conductor 404 may be used on one side of the resilient layer 402, and a decorative ink 406 optionally may be applied to the other side. In certain example embodiments, the conductor 404 may be transparent and, as indicated, the decorative ink 406 is optional. In certain example embodiments, the conductor 404 and/or the decorative ink 406 may be translucent or otherwise impart coloration or aesthetic features to the shutter 312. In certain example embodiments, the resilient layer 402 may be formed from a shrinkable polymer such as, for example, PEN, PET, polyphenylene sulfide (PPS), polyether ether ketone (PEEK), etc. The resilient layer 402 may be 1-25 microns thick in certain example embodiments. The conductor 404 may be formed from the same or different material as that used for conductor 306, in different example embodiments. Metal or metal oxide materials may be used, for example. In certain example embodiments, a 10-50 nm thick material including a layer comprising, for example, ITO, Al, Ni, NiCr, tin oxide, and/or the like, may be used. In certain example embodiments, the sheet resistance of the conductor 404 may be in the range of 40-200 ohms/square. It will be appreciated that different conductivity values and/or thicknesses (such as, for example, the example thicknesses set forth in the tables below) may be used in different example embodiments.

The decorative ink 406 may include pigments, particles, and/or other materials that selectively reflect and/or absorb desired visible colors and/or infrared radiation. In certain example embodiments, additional decorative ink may be applied to the shutter 312 on a side of the conductor 404 opposite the resilient layer 402.

As FIG. 2 shows, the shades 202*a* and 202*b* ordinarily are coiled as spiral rolls, with an outer end of the spiral affixed by an adhesive to the substrates 102 and 104 (e.g., or the dielectric thereon). The conductor 404 may be electrically connected via a terminal to a lead or the like and may serve as a variable electrode of a capacitor having the conductor 306 as its fixed electrode and the dielectric 308 as its dielectric.

When an electrical drive is provided between the variable electrode and the fixed electrode, e.g., when an electric drive of voltage or electrical charge or current is applied between the conductor 404 of the shutter 312 and the conductor 306 on the substrate 302, the shutter 312 is pulled toward the substrate 302 via an electrostatic force created by the potential difference between the two electrodes. The pull on the variable electrode causes the coiled shade to roll out. The electrostatic force on the variable electrode causes the shutter 312 to be held securely against the fixed electrode of the substrate 302. As a result, the ink coating layer 406 of the shade helps selectively reflect or absorb certain visible colors and/or infrared radiation by being interposed in the light path through the IG unit. In this way, the rolled-out shade helps control radiation transmission by selectively blocking and/or reflecting certain light or other radiation from passing through the IG unit, and thereby changes the overall function of the IG unit from being transmissive to being partially or selectively transmissive, or even opaque in some instances.

When the electrical drive between the variable electrode and the fixed electrode is removed, the electrostatic force on the variable electrode is likewise removed. The spring constant present in the resilient layer 402 and the conductor 404 causes the shade to roll up back to its original, tightly-wound position. Because movement of the shade is controlled by a primarily capacitive circuit, current essentially only flows while the shade is either rolling out or rolling up. As a result, the average power consumption of the shade is extremely low. In this way, several standard AA batteries may be used to operate the shade for years, at least in some instances.

In one example, the substrate 302 may be 3 mm thick clear glass commercially available from the assignee. An acrylic-based adhesive having a low haze may be used for adhesive layer 310. Sputtered ITO having a resistance of 100-300 ohms/square may be used for the conductor 306. The polymer film may be a low-haze (e.g., <1% haze) PET material that is 12 microns thick. A PVC-based ink available from Sun Chemical Inc. applied to 3-8 microns thickness may be used as the decorative ink 406. A PEN material commercially available from DuPont that is 6, 12, or 25 microns thick may be used as the resilient layer 402. For an opaque conductor, evaporated Al that has a nominal thickness of 375 nm may be used. For a transparent option, sputtered ITO may be used. In both cases, the sheet resistance may be 100-400 ohms/square. (If aluminum is used, the sheet resistance may be lower than 100 ohms/square; in certain example embodiments, it even may be less than 1 ohm/square.) The ITO or other conductive material(s) may be sputtered onto, or otherwise formed on, their respective polymer carrier layers in certain example embodiments. Of course, these example materials, thicknesses, electrical properties, and their various combinations and sub-combinations, etc., should not be deemed limiting unless specifically claimed.

As will be appreciated from the description above, the dynamic shade mechanism uses a coiled polymer with a conductive layer. In certain example embodiments, the conductor may be formed to be integral with the polymer 402, or it may be an extrinsic coating that is applied, deposited, or otherwise formed on the polymer 402. As also mentioned above, decorative ink 406 may be used together with a transparent conductor material (e.g., based on ITO) and/or an only partially transparent or opaque conductive layer. An opaque or only partially transparent conductive layer may obviate the need for ink in certain example embodiments. In this regard, a metal or substantially metallic material may be used in certain example embodiments. Aluminum is one example material that may be used with or without a decorative ink.

One or more overcoat layers may be provided on the conductor to help reduce the visible light reflection and/or change the color of the shade to provide a more aesthetically pleasing product, and/or by "splitting" the conductor so that a phase shifter layer appears therebetween. Overcoats thus may be included to improve the aesthetic appearance of the overall shade. The shutter 312 thus may include a reflection-reducing overcoat, dielectric mirror overcoat, or the like. Such reflection-reducing overcoats and dielectric mirror overcoats may be provided over a conductor 404 and on a major surface of the shade polymer 402 comprising (for example) PEN opposite decorative ink 406. It will be appreciated, however, that the ink 406 need not be provided, e.g., if the conductor 404 is not transparent. Mirror coatings such as, for example, Al, may obviate the need for decorative ink 406. It also will be appreciated that the reflection-reducing overcoat and the dielectric mirror overcoat may be provided on major surfaces of the shade polymer 402 comprising (for example) PEN opposite the conductor 404 in certain example embodiments.

In addition to or in place of using optical interference techniques to reduce reflection, it also is possible to add a textured surface to the base polymer, modifying the conductive layer chemically or physically, and/or add an ink layer, e.g., to accomplish the same or similar ends, achieve further reductions in unwanted reflection, etc.

Given that the thin film and/or other materials comprising the shutter should survive numerous rolling and unrolling operations in accordance with the functioning of the overall shade, it will be appreciated that the materials may be selected, and that the overall layer stack formed, to have mechanical and/or other properties that facilitate the same. For example, an excess of stress in a thin film layer stack typically is seen as disadvantageous. However, in some instances, excess stress can lead to cracking, "delamination"/removal, and/or other damage to the conductor 404 and/or an overcoat layer or layers formed thereon. Thus, low stress (and in particular low tensile stress) may be particularly desirable in connection with the layer(s) formed on the shutters' polymer bases in certain example embodiments.

In this regard, the adhesion of sputtered thin films depends on, among other things, the stress in the depositing film. One way stress can be adjusted is with deposition pressure. Stress versus sputter pressure does not follow a monotonic curve but instead inflects at a transition pressure that in essence is unique for each material and is a function of the ratio of the material's vaporization temperature (or melting temperature) to the substrate temperature. Stress engineering can be accomplished via gas pressure optimizations, bearing these guideposts in mind.

Other physical and mechanical properties of the shade that may be taken into account include the elastic modulus of the polymer and the layers formed thereon, the density ratio of the layers (which may have an effect on stress/strain), etc. These properties may be balanced with their effects on internal reflection, conductivity, and/or the like.

As is known, temperatures internal to an IG unit may become quite elevated. For example, it has been observed that an IG unit in accordance with the FIG. 2 example and including a black pigment may reach a temperature of 87 degrees C., e.g., if the black portion of the shade is facing the sun in elevated temperature, high solar radiation climates (such as, for example, in areas of the southwest United States such as Arizona). The use of a PEN material for the rollable/unrollable polymer may be advantageous, as PEN has a higher glass transition temperature (~120 degrees C.), compared to other common polymers such as PET (Tg=67-81 degrees C.), Poly Propylene or PP (Tg=~32 degrees C.). Yet if the PEN is exposed to temperatures approaching the glass transition temperature, the performance of the material's otherwise advantageous mechanical properties (including its elastic modulus, yield strength, tensile strength, stress relaxation modulus, etc.) may degrade overtime, especially with elevated temperature exposure. If these mechanical properties degrade significantly, the shade may no longer function (e.g., the shade will not retract).

In order to help the shade better withstand elevated temperature environments, a substitution from PEN to polymers with better elevated temperature resistance may be advantageous. Two potential polymers include PEEK and Polyimide (PI or Kapton). PEEK has a Tg of ~142 degrees C. and Kapton HN has a Tg of ~380 degrees C. Both of these materials have better mechanical properties in elevated temperature environments, compared to PEN. This is especially true at temperature above 100 degrees C. The following chart demonstrates this, referencing mechanical properties of PEN (Teonex), PEEK, and PI (Kapton HN). UTS stands for ultimate tensile strength, in the chart.

| | | PEN | PEEK | PI |
|---|---|---|---|---|
| 25 degrees C. | UTS (psi) | 39,000 | 16,000 | 33,500 |
| | Modulus (psi) | 880,000 | 520,000 | 370,000 |
| | Yield (psi) | 17,500 | | 10,000 |
| 200 degrees C. | UTS (psi) | 13,000 | 8,000 | 20,000 |
| | Modulus (psi) | | | 290,000 |
| | Yield (psi) | <1,000 | | 6,000 |
| Tg | | ~121 degrees C. | ~143 degrees C. | ~380 degrees C. |

It will be appreciated that the modification of the shade base material from its current material (PEN) to an alternate polymer (e.g., PEEK or PI/Kapton) that has increased elevated temperature mechanical properties may be advantageous in the sense that it may enable the shade to better withstand internal IG temperatures, especially if the shade is installed in higher temperature climates. It will be appreciated that the use of an alternative polymer may be used in connection with the shutter and/or the on-glass layer in certain example embodiments.

In addition, or as an alternative, certain example embodiments may use a dyed polymer material. For example, a dyed PEN, PEEK, PI/Kapton, or other polymer may be used to created shades with an assortment of colors and/or aesthetics. For instance, dyed polymers may be advantageous for embodiments in transparent/translucent applications, e.g., where the shade conductive layer is a transparent conductive coating or the like.

Alternate conductive materials that beneficially modify the spring force of the coiled shade to make it usable for various lengths may be used. In this regard, properties of the conductive layer that increase the strength of the coil include an increase in the elastic modulus, an increase in the difference in coefficient of thermal expansion (CTE) between the polymer substrate and the conductive layer, and an increase in the elastic modulus to density ratio. Some of the pure metals that can be used to increase coil strength compared to Al or Cr include Ni, W, Mo, Ti, and Ta. The elastic modulus of studied metal layers ranged from 70 GPa for Al to 330 GPa for Mo. The CTE of studied metal layers ranged from $23.5\times10^{-6}$/k for Al down to $4.8\times10^{-6}$/k for Mo. In general, the higher the elastic modulus, the higher the CTE mismatch between the PEN or other polymer and the metal, the lower the density, etc., the better the material selection in terms of coil formation. It has been found that incorporating Mo and Ti based conductive layers into shades has resulted in a spring force of the coil that is significantly higher than that which is achievable with Al. For example, a polymer substrate based on PEN, PEEK, PI, or the like, may support (in order moving away from the substrate) a layer comprising Al followed by a layer comprising Mo. Thin film layer(s) in a conductive coating and/or a conductive coating itself with a greater modulus and lower CTE than Al may be provided.

A PEN, PI, or other polymer substrate used as a shutter may support a thin layer comprising Al for stress-engineering purposes, with a conductive layer comprising Mo, Ti, or the like directly or indirectly thereon. The conductive layer may support a corrosion-resistant layer comprising Al, Ti, stainless steel, or the like. The side of the substrate opposite these layers optionally may support a decorative ink or the like.

Figure 5:
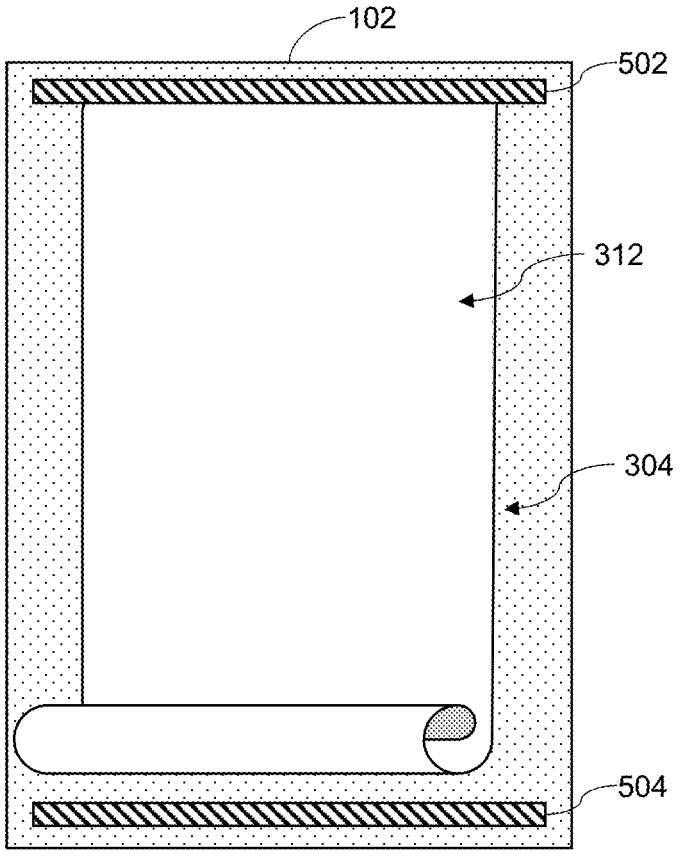
FIG. 5 is a plan view of a substrate incorporating on-glass components from the FIG. 3 example and shutter components from the FIG. 4 example, in accordance with certain example embodiments.

FIG. 5 is a plan view of a substrate 102 incorporating on-glass components 304 from the FIG. 3 example and shutter components 312 from the FIG. 4 example, in accordance with certain example embodiments. The shutter 312 extends from the anchor bar 502 toward the stop 504 when moving to the shutter closed position. The shutter retracts from the stop 504 towards the anchor bar 502 when moving to the shutter open position.

Certain example embodiments may include microscopic perforations or through-holes that allow light to pass through the shade and provide progressive amounts of solar transmittance based on the angle of the sun.

Further manufacturing, operation, and/or other details and alternatives may be implemented. See, for example, U.S. Pat. Nos. 8,982,441; 8,736,938; 8,134,112; 8,035,075; 7,705,826; and 7,645,977, as well as U.S. application Ser. No. 16/028,546 filed Jul. 6, 2018; the entire contents of each of which is hereby incorporated herein by reference. Among other things, perforation configurations, polymer materials, conductive coating designs, stress engineering concepts, building-integrated photovoltaic (BIPV), and other details are disclosed therein and at least those teachings may be incorporated into certain example embodiments.

As will be appreciated from the description above, one issue associated with the dynamic shade design relates to formation of the retractable shutter. In particular, care may be taken to select and implement materials with a spring force sufficient to enable automatic retraction over time. It oftentimes will be important to tightly control manufacturing parameters to ensure that the shutter is properly created so as to have a spring force sufficient for retraction, and to ensure that the spring force remains sufficient to cause retraction over the life of the window or other product into which the shutter is integrated. If the spring constant is not sufficient, or if it degrades over time, the shutter may become "stuck" in an extended or partially extended position. This may be the case even if voltage is not applied, simply because the spring constant will be insufficient to cause the re-rolling. Furthermore, even if spring constants are properly formed and remain sufficiently high to at least in theory provide for retraction over time, after repeat usage, electrostatic charges can build up. This charge build-up may cause the shutter to become "stuck" in an extended or partially extended position in a manner similar to the above, even when power is not provided. "Pole swapping," which in this context refers to a natural phenomenon that can hinder the operation of the shutter and might be thought of as relating to surface charge (on the dielectric surface) or semi-permanent electrostatic polarization (in the dielectric volume), also can hinder the operation of the shutter. And because of the closed system, it can be difficult and sometimes even impossible to repair and/or replace faulty shutters and/or shutters that have "worn out" over time, systems where excessive charges have built-up and/or where poles have switched, etc.

In certain example embodiments, one electric potential can be used to help extend the shutter in one direction, and another electric potential to retract the shade in another direction opposite to the first. For instance, a shutter may be designed with a layer stack such that a circuit connected thereto may be selectively switchable between providing a down force and an up force. As will be described in greater detail below, an electric field can be provided to facilitate the retraction. The electric field may be set up to simply encourage retraction (e.g., if the shutter becomes stuck) in certain example embodiments. In certain example embodiments, the electric field may be set up for the entire retraction operation.

In this way, certain example embodiments can help address pole swapping and charge build-up issues, while also providing an approach that fights aging and deterioration of the spring over time (e.g., thereby promoting durability and enhancing longevity). In addition, or in the alternative, certain example embodiments enable materials with a lower spring constant to be used, as the techniques may be used to simply "encourage" a small amount of winding at the beginning of the retraction, and/or at one or more times when the retraction stalls. This also may be advantageous because manufacturing tolerances may be loosened, and the ease of manufacturing may be promoted.

Certain example embodiments provide a dynamic shade with alternating conductive and dielectric layers. For example, at least four layers alternating between conductive layers and dielectric layers may be provided in certain example embodiments. When the shade is partly curled (e.g., part of the shade remains flat), the conductive layers are separated from each other by the dielectric layers. A voltage applied between the conductive layers creates an electric field that attracts the curled portion to the flattened portion, retracting the shade.

Figure 6:
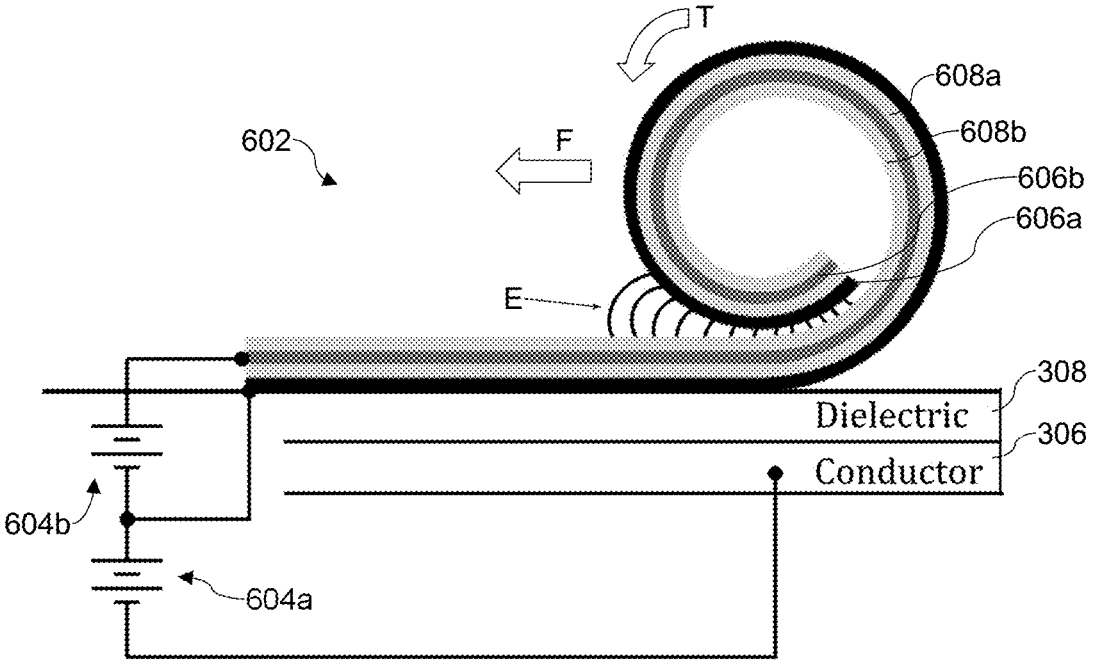
FIG. 6 is a schematic view of a first example shade with an electrostatic retraction feature implemented using two independent voltage sources, according to certain example embodiments.

FIG. 6 is a schematic view of a first example shade 602 with an electrostatic retraction feature implemented using two independent voltage sources **604*a*-604*b*, according to certain example embodiments. In FIG. 6, the shade polymer is omitted for clarity. The two voltage sources 604*a*-604*b* are independently controllable. A first voltage source provides the usual functionality as a standard shade. In FIG. 6, the first voltage source 604***a* is shown as the lower voltage symbol, whose negative terminal connects to the backplane conductor, which may be the conductor 306 located below the dielectric 308 in the on-glass components 304 (described, for example, in connection with FIG. 3). In ordinary operation, this is a variable source, whose polarity and voltage can reverse.

The second voltage source actuates the reverse rolling force. In FIG. 6, the second voltage source 604*b* is shown as the as the upper voltage symbol. Increasing the potential difference of the second voltage source 604*b* creates an electric field E between first and second conductive layers 606*a*-606*b* on the rollable shutter. The first and second conductive layers 606*a*-606*b* are separated by first and second dielectric layers 608*a*-608*b*, as will be appreciated from the above. The resulting torque T acts counterclockwise to produce a force F acting to the left (in this schematic view and in this example orientation). It will be appreciated that, in operation, the resulting torque acts in a rolling direction opposite to the unfurling (generally counterclockwise for vertical and substantially vertical installations) that produce a force acting towards the retracted position (generally the top for vertical and substantially vertical installations). Of course, it will be appreciated that the torque will depend in part on the viewpoint. For instance, if the shade unfurls to the left, or if the same shade is viewed from the opposing edge, the torque appears clockwise.

Figure 7:
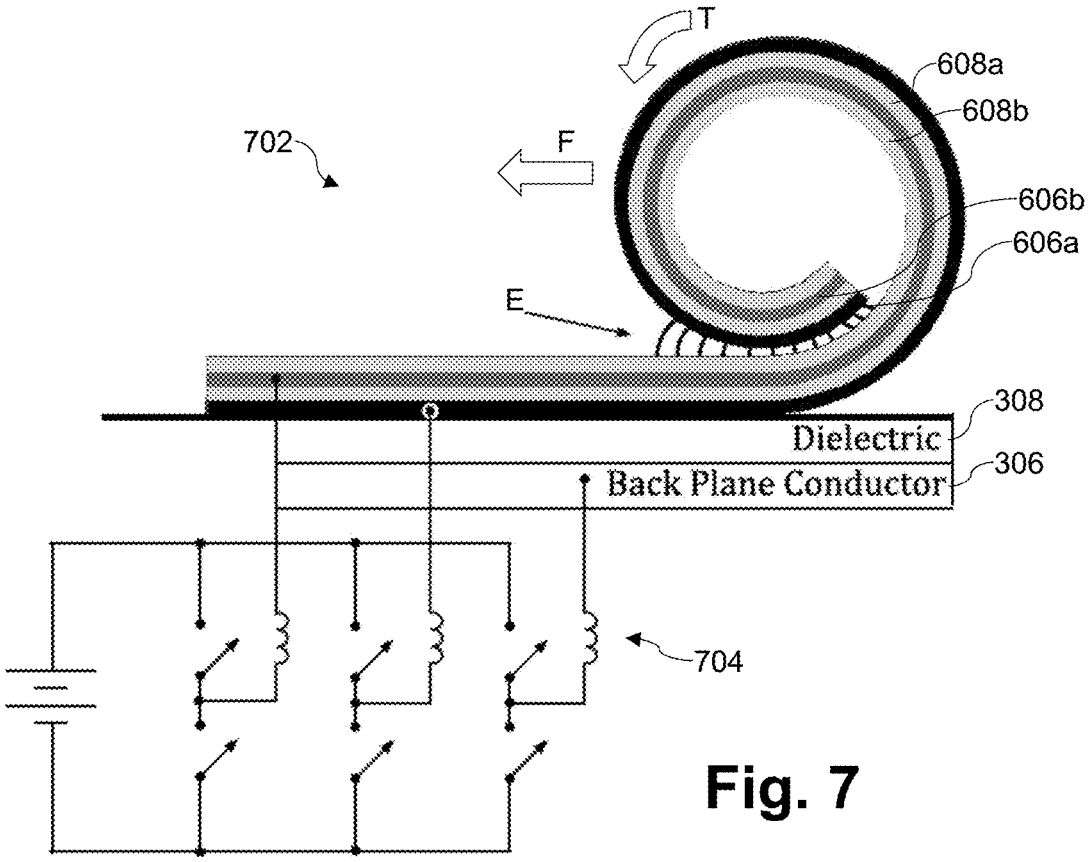
FIG. 7 is a schematic view of a second example shade with an electrostatic retraction feature implemented using voltage sources, according to certain example embodiments.

FIG. 7 is a schematic view of a second example shade 702 with an electrostatic retraction feature implemented using voltage sources, according to certain example embodiments. In FIG. 7, the shade polymer is omitted for clarity. The FIG. 7 shade 702 is similar to the FIG. 6 shade 602. As above, increasing the potential difference creates an electric field E between first and second conductive layers 606*a*-606*b* on the rollable shutter. The first and second conductive layers 606*a*-606*b* are separated by first and second dielectric layers 608*a*-608*b*. The resulting torque T produces a force F, acting to encourage the shutter as a whole to retract. FIG. 7 differs from FIG. 6 in terms of the control circuitry 704 used. For instance, in certain example embodiments, a two-phase H-bridge with a series connected inductor may be extended and generalized to include a third electrode, forming a three-phase bridge. Three-phase bridge circuits can be realized using low-cost gate driver technology commonly used in high voltage motor controllers (such as for the hybrid automotive industry). The circuitry 704 includes three individually connected inductors in series with each bridge output terminal to enable energy recovery for high efficiency.

As noted above, 100-600 V DC is appropriate for extension in most applications, and the same or similar range may be used for retraction. In certain example embodiments, the voltage output of a bridge output terminal can be maintained anywhere between +– supply voltage by appropriate restriction of the current. Appropriate pulse width modulation (PWM) waveforms may be used in certain example embodiments. In this regard, PWM generally requires voltage and/or current measurement to provide feedback signals in a control loop. It will be appreciated that the precise duty cycle and duration can be determined by those skilled in the art. In certain example embodiments, a two-phase "H-bridge" or three-phase bridges may be seen as being advantageous over the circuit of FIG. 6 (for example), as only a single voltage source is necessary.

As described above, a shutter 312 may include a biaxially-oriented polymer-based layer (e.g., of or including PEN or the like). The polymer-based layer may be coated with a metal conductor on one side, followed by ink coatings on one or both sides. In this construction, both the ink layer(s) and the polymer-based layer act as dielectrics.

Figure 8:
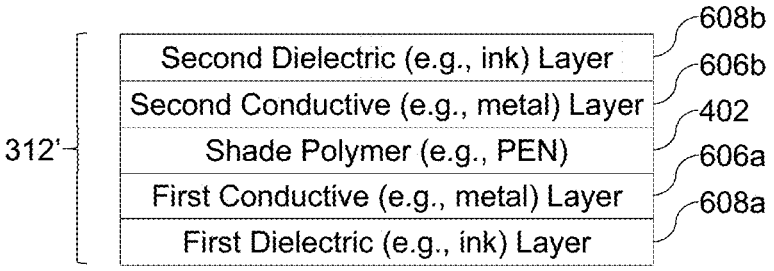
FIG. 8 is a cross-sectional view of a first shutter usable in connection with electrostatic retraction, in accordance with certain example embodiments.

FIG. 8 is a cross-sectional view of a first shutter 312' usable in connection with electrostatic retraction, in accordance with certain example embodiments. The shutter 312' for use with electrostatic retraction may have alternating conductive and dielectric layers, as noted above. Four layers, as shown in FIGS. 6-7, for example, may be provided as a minimum in certain example embodiments (e.g., in addition to a shade polymer layer).

The shutter 312' for use with electrostatic retraction according to FIG. 8 may be constructed by adapting or changing the FIG. 4 example. For instance, in certain example embodiments, both sides of a polymer-based layer 402 (e.g., of or including PEN) may be coated with metal or other conductive coatings, followed by ink coatings provided on one or both sides. Providing ink to both sides may help create a more desirable aesthetic appearance in certain example embodiments, as the shade will not have a shiny metal appearance when viewed from either side of the shade. Thus, in FIG. 8, first and second conductive (e.g., metal) layers 606*a*-606*b* sandwich the polymer-based layer 402, and first and second dielectric (e.g., ink) layers 608*a*-608*b* also sandwich the polymer-based layer 402. As shown in FIG. 8, the that first and second dielectric layers 608*a*-608*b* are provided on surfaces opposite the surfaces of the first and second conductive layers 606*a*-606*b* that are adjacent to the polymer-based layer 402.

Example thicknesses for the layers are provided in the table below:

| Layer/Material | Preferred Thickness | More Preferred Thickness | Example Thickness |
|---|---|---|---|
| Ink (608a) | 1-10 μm | 2-5 μm | 2 μm |
| Aluminum (606a) | 100-600 nm | 200-450 nm | 300 nm |
| PEN (402) | 5-100 μm | 5-25 μm | 12 μm |
| Aluminum (606b) | 5-100 nm | 20-75 nm | 50 nm |
| Ink (608b) | 1-10 μm | 2-5 μm | 2 μm |

Generally, a thickness of at least 30 nm when aluminum is used for layer 606*b* is desirable to enable good electrical contact. It will be appreciated that the ink itself may be formulated for conductivity in certain example embodiments. In certain of such cases, one conductive layer (e.g., layer 606*b* comprising aluminum) may be replaced with a conductive ink, e.g., in essence combining layers 606*b* and 608*b* into a single layer.

In certain example embodiments, the ink layers have the same thickness (e.g., 2 μm). Although different inks and/or colors vary in opacity, a 2 μm thickness generally is approximately the minimum necessary to produce an opaque coating. The shade polymer (e.g., PEN) layer and the first conductive layer of or including aluminum may be standard thicknesses for shutters that lack electrostatic retraction functionality. The "added" second conductive layer of or including aluminum may be provided at a thickness that is less than the first conductive layer of or including aluminum. This may be desirable in certain example embodiments to help reduce the changes in mechanical properties relative to the shade. For example, a good shade that is unlike to crack or delaminate and has a good spring constant can be realized. This thickness arrangement has been found to be advantageous in helping to maintain compatibility with thermal processes used in forming shades including, for example, processing the flat material to produce the curl, in certain example embodiments.

Figure 9:
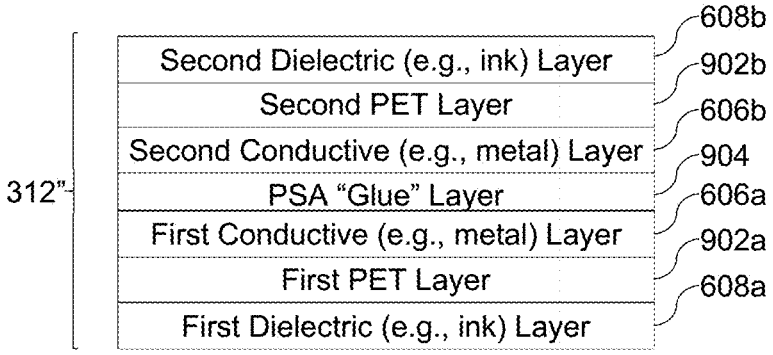
FIG. 9 is a cross-sectional view of a second shutter usable in connection with electrostatic retraction, in accordance with certain example embodiments.

FIG. 9 is a cross-sectional view of a second shutter 312" usable in connection with electrostatic retraction, in accordance with certain example embodiments. The FIG. 9 example embodiment may be produced by differential tension lamination in certain example embodiments. For instance two (or more) main components may be manufactured. The first component may include a first polymer-based layer 902*a* (of or including PET, PEN, and/or the like). This first polymer-based layer 902*a* supports, on opposite major surfaces thereof, the first dielectric (e.g., ink) layer 608*a* and the first conductive (e.g., metal) layer 606*a*. In a similar fashion, the second component may include a second polymer-based layer 902*b* (of or including PET, PEN, and/or the like). The second polymer-based layer 902*b* supports, on opposite major surfaces thereof, the second dielectric (e.g., ink) layer 608*b* and the second conductive (e.g., metal) layer 606*b*.

A mechanical spring force is developed in the differential tension between the first and second conductive layers 902*a*-902*b* (which, as above, may be of or include aluminum). A pressure sensitive adhesive (PSA) or "glue" layer 904 connects the two components together. In addition, the glue 904 acts as a dielectric to separate the first and second conductive layers 902*a*-902*b*. In addition, or in the alternative, heat bonding may be used in certain example embodiments. In this regard, polyethylene (e.g., LDPE) may be bonded without added adhesive at reasonable temperatures compatible with other processing operations. In this example, electrostatic retraction is caused by an electric field that acts through both ink layers 608*a*-608*b* and both PET layers 902*a*-902*b*.

Example thicknesses for the layers are provided in the table below:

| Layer/Material | Preferred Thickness | More Preferred Thickness | Example Thickness |
|---|---|---|---|
| Ink (608a) | 1-10 μm | 2-5 μm | 2 μm |
| PET (902a) | 1-50 μm | 2-25 μm | 5 μm |
| Aluminum (606a) | 100-600 nm | 200-450 nm | 300 nm |
| PSA Glue (904) | 5-100 μm | 5-25 μm | 12 μm |
| Aluminum (606b) | 100-600 nm | 200-450 nm | 300 nm |
| PET (902b) | 1-50 μm | 2-25 μm | 5 μm |
| Ink (608b) | 1-10 μm | 2-5 μm | 2 μm |

Figure 10:
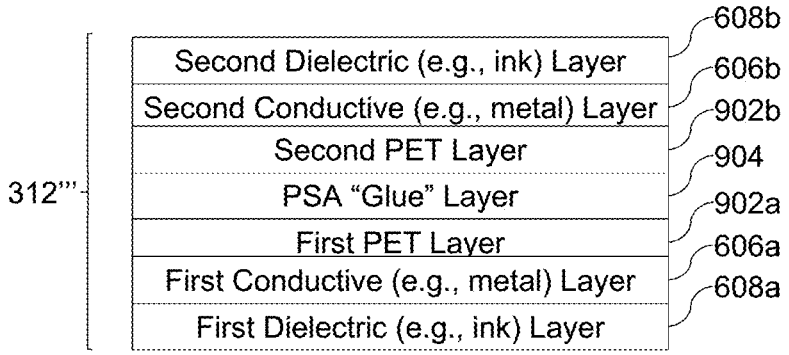
FIG. 10 is a cross-sectional view of a third shutter usable in connection with electrostatic retraction, in accordance with certain example embodiments.

In certain example embodiments, different materials may be used for the conductive (e.g., metal) layers that in the table above include layers 606*a* and 606*b* comprising aluminum, and/or different materials may be used for the polymer (e.g., PET) layers that in the table above include layers 902*a* and 902*b* comprising PET. For instance, PET, PEN, and/or the like may be used. In certain example embodiments, the order of the conductive and polymer layers may be reversed. For instance, the following order of layers may be used in certain example embodiments: ink/conductive (e.g., metal) layer/polymer/(optional) glue/polymer conductive (e.g., metal) layer/ink. FIG. 10, which is a cross-sectional view of a third shutter 312''' usable in connection with electrostatic retraction, in accordance with certain example embodiments, shows this arrangement. This arrangement may be advantageous in certain example embodiments, in that it helps increase the effective thickness of the dielectrics separating the two conductive layers. This will decrease the fixed value capacitance that does not contribute to the retraction force but does require energy to charge. The same or similar thicknesses may be used in this arrangement.

The total effective dielectric thickness includes the thicknesses of the ink layers as well as the PET layers, plus any entrapped air. In certain example embodiments, this thickness may be 4-120 μm, more preferably 8-60 μm, with an example being 14 μm. In certain example embodiments, the thicknesses of the first and second ink layers may be the same or substantially the same. In certain example embodiments, the thicknesses of the first and second PET layers may be the same or substantially the same. In certain example embodiments, the thicknesses of the first and second conductive (e.g., metal aluminum or other material) layers may be the same or substantially the same. In this case, "substantially the same" means thickness variations of no more than 15%, more preferably thickness variations of no more than 10%. Having a common thickness is available here, at least in some instances. For thermally processed shades with equal aluminum thicknesses, the stress in the aluminum layers would counteract each other to result in very weak shades, for example. Ordinarily, the compression in a single aluminum layer would be counterbalanced by tension in the polymer (e.g., PEN) layer.)

Although the examples discussed in connection with FIG. 8-9 list several candidate materials for the conductive and polymer-based layers, it will be appreciated that any of the materials described herein (and/or other suitable materials) may be used in place of, or together with, those materials. For instance, in certain example embodiments, the conductive layers may be of or include Al, Cu, Mo, Ti, NiCr, and/or the like. Copper has been found to be advantageous in that it includes a high resilience (elastic energy storage at yield stress) of available metal coatings, and maximum shade length has been found to correlate directly with resilience. For high performance, an interleaved structure of aluminum with 60 nm copper, for example, may be implemented, and may provide a high level of resilience. In certain example embodiments, the polymer-based layers may be of or include PEN, PET, PI, and/or the like. Although pressure sensitive adhesives have been described, it will be appreciated that other materials may be used to connect polymer-based and/or other materials together. Laminates and other adhesives may be used, for instance.

An advantage of the electrostatic retraction concept described herein is that the electric field increases pressure between shade windings. This pressure increases the normal force between layers and increases interwinding friction forces. If the interwinding static friction force is high enough, the windings cannot slide upon each other. Without sliding, the shade will track in a straight direction and will prevent telescoping and skewing. Thus, certain example embodiments are advantageous in that they reduce the likelihood (and sometimes prevent the occurrence) of skewing and/or telescoping.

In certain example embodiments, voltage may be applied and left on until the shade is fully retracted. In certain example embodiments, voltage may be provided to create the electrostatic force for retraction at one or more predefined times and/or in accordance with a timing pattern. For example, when retraction is triggered, voltage may be provided to create the electrostatic force for retraction immediately and at predefined time intervals (e.g., every 2-5 ms). The voltage for retraction may be cycled on and off in accordance with a predefined pattern until the shade is determined to be in its fully retracted position in certain example embodiments. A determination of fully retraction may be made using optical means (e.g., scanning to determine whether the shade is rolled up at the top or other desired location of the article in which it is disposed), by triggering a manual actuator (e.g., caused by the roll achieving its full thickness), through electrical sensing (e.g., based on the conductive layers making contact with a bus line or the like provided at the top or other desired location of the article in which it is disposed), etc.

In certain example embodiments, the cycling may take place over a time period during which the shade is anticipated to retract (e.g., based on testing or the like). For instance, if the shade is known or expected to become fully retracted in 10 ms, 5 pulses may be provided at 2 ms intervals may be provided to "encourage" the full retraction.

In addition or as an alternative to providing a fixed timing for pulses to encourage retraction, optics, mechanical actuators, electrical means, and/or the like, may be used in a similar manner as that described above, to determine whether to provide an "on-demand" voltage to encourage retraction. That is, these means may be provided to help determine whether the shutter is "stuck" in an extended or only partially retracted position. If the shutter is determined to be stuck, regardless of whether fixed timings are used, a voltage may be created to help encourage the torque associated with retraction rolling.

As still another option that can be used with the above, manual operation may trigger voltage to encourage retraction. This manual action may be encouraged when a human user notices that the shutter is stuck, has telescoped, etc.

A boosting transformer (e.g., a flyback transformer) or the like additionally or alternatively may be incorporated into certain example embodiments, e.g., to help further reduce the effects of pole swapping. The techniques set forth in U.S. application Ser. No. 16/947,014 filed on Jul. 15, 2020, may be used in this regard. The entire contents of the '014 application is hereby incorporated herein by reference.

To help even further reduce (and potentially even eliminate) the voltage needed to hold the shade in the extended position, certain example embodiments may make use of a modified latching stop bar, e.g., in place of the locking restraint described above. The modified latching stop bar of certain example embodiments enables an extended shade to maintain very little stored energy in some instances. Further, the latching stop bar can help reduce or eliminate shock hazards, reduce power consumption, and increase battery life.

Figure 11:
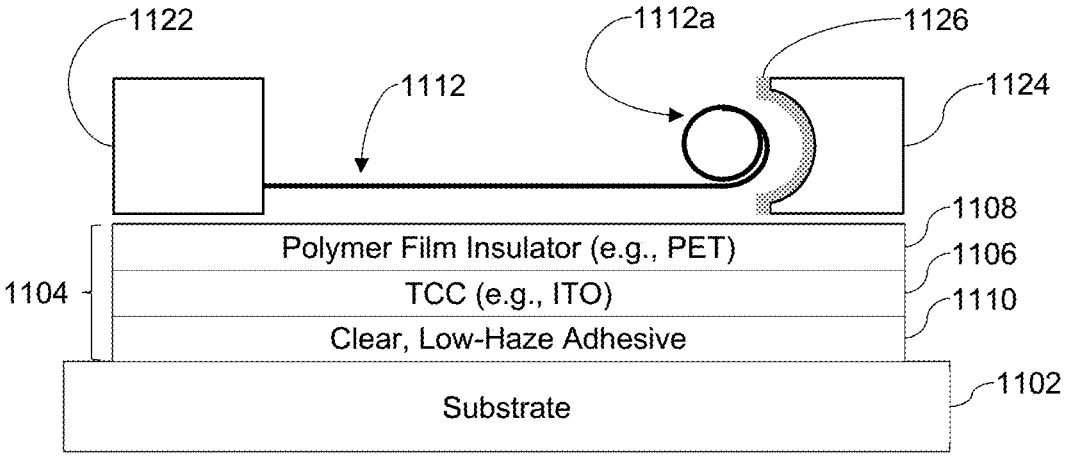
FIG. 11 is a schematic view of a portion of a dynamic shade system incorporating an electrostatic latching stop bar, in accordance with certain example embodiments.

FIG. 11 is a schematic view of a portion of a dynamic shade system incorporating an electrostatic latching stop bar, in accordance with certain example embodiments. In FIG. 11, the second substrate and spacer system are removed for ease of understanding. The elements of FIG. 11 are similar to those shown in and described above in connection with FIG. 3. For example, a substrate 1102 supports on-glass components 1104 including a first conductive coating 1106 supported by a first dielectric 1108. These on-glass components 1104 are coupled to the substrate 1102 via the clear, low-haze adhesive 1110. The same or similar materials as those described above may be used in connection with the on-glass components 1104. For example, the first conductive coating 1106 may include a layer comprising ITO, the first dielectric 1108 may be a polymer film insulator such as, for example, PET, etc.

The shutter 1112 extends from the anchor bar 1122 towards the electrostatic latching stop bar 1124. The shutter roll 1112*a* is shown nearly fully extended in the FIG. 11 schematic view. Similar to FIG. 4 and the related discussion, the shutter 1112 includes layers comprising, in order moving away from the substrate 1102, an optional decorative ink layer, a second conductive coating supported by a shade polymer, and another optional decorative ink layer. The same or similar materials as those described above may be used in connection with the shutter 1112. For example, the shade polymer may comprise PEN; the second conductive coating may comprise ITO, Al, Mo, or another metal; etc.

Although the designs shown in and described in connection with FIGS. 3-4 may be used in certain example embodiments, it will be appreciated that the designs shown in and described in connection with FIGS. 8-10 may be used in connection with different example embodiments. This may be useful in situations where it is desirable to implement both a latching stop bar as well as powered retraction of the shutter.

The latching stop bar 1124 supports a dielectric material 1126 on a surface that faces the anchor bar 1122. The latching stop bar 1124 itself may comprise a comparatively large conductive structure such as, for example, an aluminum extrusion, a brass shim, or other conductor. The face of the latching stop bar 1124 facing the anchor bar 1122 may have a profile, which helps accommodate the shutter roll 1112*a* when it is unfurled. As shown schematically in FIG. 11, the profile is curved and generally complements the shape of the shutter roll 1112*a*. In other words, when viewed in side cross-section, the shutter roll 1112*a* is generally circular and is received by the generally semi-circular cutaway in the profile of the latching stop bar 1124.

The dielectric material 1126 may comprise a polymer based material such as, for example, PI, PEN, PET, PMMA, and/or the like. In certain example embodiments, a PI tape (e.g., a Kapton tape) may be easily applied over the face of the latching stop bar 1124 that faces the anchor bar 1122.

In certain example embodiments, the latching stop bar 1124 is electrically isolated from the shade (including the on-glass components 1104, the shutter 1112), as well as the anchor bar 1122. Unlike some current designs, the anchor bar 1122 and the latching stop bar 1124 are not electrically connected to one another. This design makes it possible to separately energize the latching stop bar 1124.

In this sense, there are three separate electrodes provided in the FIG. 11 example shade system. The first electrode is defined in connection with the on-glass components 1104. The second electrode is defined in connection with the anchor bar 1122 and the shutter 1112. The third electrode is defined in connection with the latching stop bar 1124. As alluded to above, each electrode may be separately activated in certain example embodiments.

It will be appreciated that it may be desirable to control the anchor bar 1122 and the shutter 1112 together, e.g., in the context of a single voltage provided to a single electrode. This is because the anchor bar 1122 provides a good deal of "real estate" and makes it easier to form an electrical connection, e.g., compared to the shutter 1112, which can be quite small, roll up, and not have much surface area for forming an electrical connection. However, in certain example embodiments, a separate fourth electrode is defined in connection with the anchor bar 1122. In such cases, voltages may be applied to the anchor bar 1122 and the shutter 1112, independent from one another.

Figure 12:
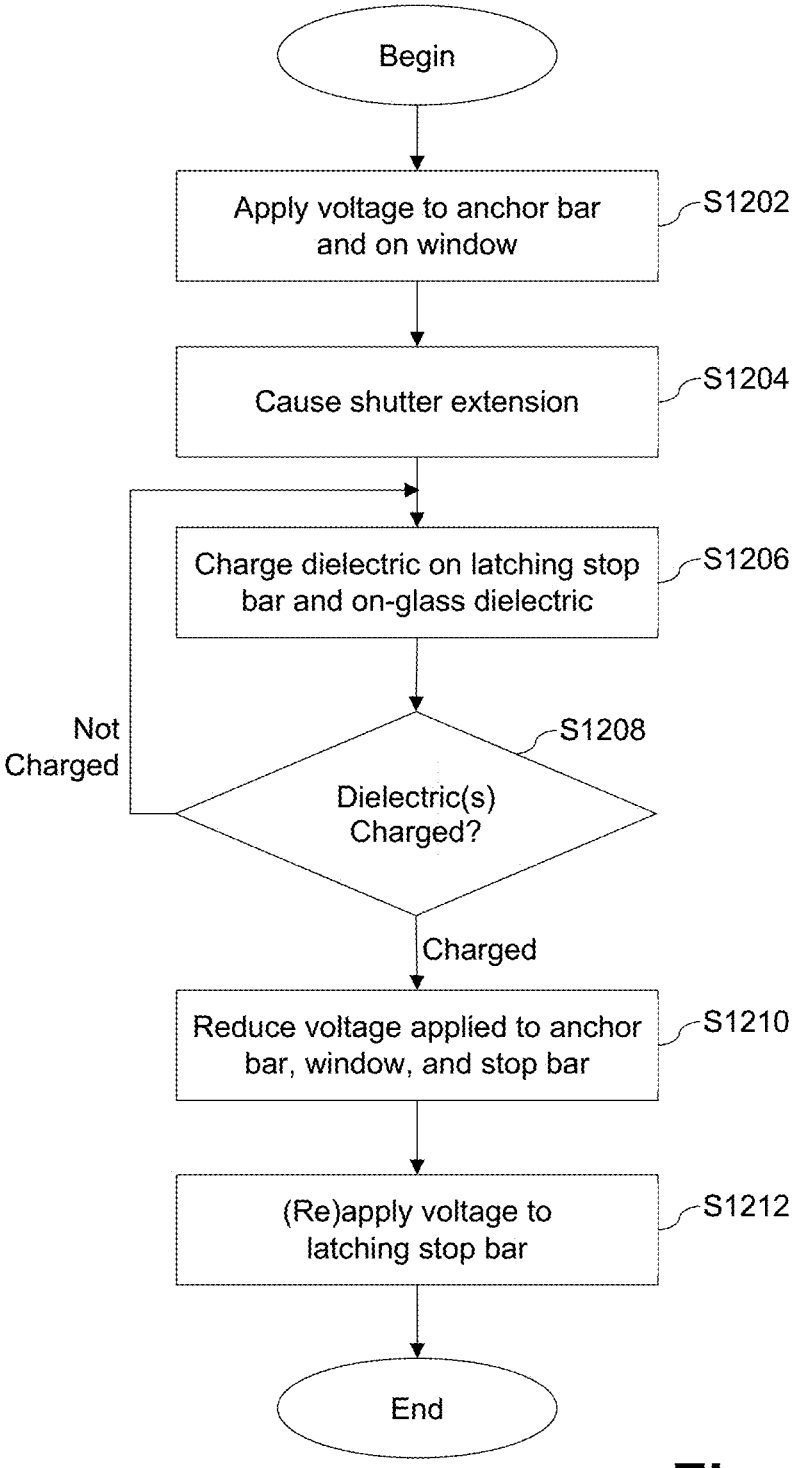
FIG. 12 is a flowchart detailing how the FIG. 11 shade system may operate in certain example embodiments.

FIG. 12 is a flowchart detailing how the FIG. 11 shade system may operate in certain example embodiments. In step S1202, voltage is applied to the anchor bar and to the on-glass components. The voltage ranges discussed above may be used in this regard. For the purposes of most applications, an example voltage of 600 V is appropriate.

The shutter is extended with the aid of electrostatic forces, as indicated in step S1204. The first and second electrodes are used in this regard.

If an electrostatic latching stop bar is not used, it is possible to reduce the voltage at least somewhat once the shutter is fully extended and the on-glass dielectric (e.g., the first dielectric 1108 in FIG. 11) is fully charged. For example, depending on the size of the window and shade, temperatures in which the overall system is operating, etc., it may be possible to back off 20-50 V if an electrostatic latching stop bar is not used.

By contrast, in certain example embodiments, the dielectric on the latching stop bar is charged in step S1206. This charging may occur before, during, and/or after the shutter extension referenced in step S1204. Charging continues until at least the dielectric on the latching stop bar is charged, as indicated in step S1208. Preferably, both the dielectric on the latching stop bar and the on-glass dielectric are fully charged. In certain example embodiments, the charging may be controlled such that the on-glass dielectric is fully charged before the dielectric on the latching stop bar is fully charged. In certain example embodiments, the charging may be controlled such that the on-glass dielectric is fully charged before the charging on the latching stop bar is started.

Once there is full charging and the shutter is fully extended, voltage provided at least to the on-glass components is reduced, e.g., in connection with the first electrode. In certain example embodiments, the voltage provided to the anchor bar can be reduced as well, e.g., in connection with the second electrode.

In certain example embodiments, the voltage provided to the on-glass components and the voltage provided to the anchor bar are reduced simultaneously. In certain example embodiments, the voltage provided to the on-glass components is reduced before the voltage provided to the anchor bar is reduced.

The voltage provided to the electrostatic latching stop bar is reduced, although the extent of the reduction may not be as large as the reduction made with respect to the on-glass components. In some instances, the voltage level provided to the latching stop bar may be maintained or substantially maintained. Maintaining or substantially maintaining the voltage provided to the electrostatic latching stop bar may be performed by providing a continual voltage, or by only temporarily reducing the voltage applied thereto (e.g., reducing the voltage somewhat and the increasing the voltage again). Similarly, a partial reduction to the voltage provided to the electrostatic latching stop bar may be performed by reducing the voltage applied thereto to a desired level independent of the voltage(s) applied to other components, or by reducing the voltage of all components and then adding back voltage for the latching stop bar. In certain example embodiments, the voltage provided to the on-glass components and/or the anchor bar is reduced and transferred to the latching stop bar.

The latter option is shown in the FIG. 12 example flowchart. That is, as shown in the FIG. 12, the voltage applied to the anchor bar, on-glass components, and stop bar is reduced in step S1210. Then, in step S1212, voltage is added back to the latching stop bar.

By way of example, in step S1210, the voltage applied on the overall circuit including the anchor bar, on-glass components, and latching bar stop may be reduced 200-300 V. Then, depending on factors such as, for example, the size of the window, the weight of the shutter, operating temperatures, etc., 100-150 V may be added to the stop via a separate circuit, as indicated in step S1212. The result in this example may involve 300-400 V provided on the window, and 400-450 provided to the stop.

Factors such as those described above can be used to determine appropriate voltage levels and voltage level reductions for the individual components. In general, the on-glass and anchor bar voltages may be reduced by at least about 20-25%, more preferably at least about 30%, and sometimes up to about 33.33%-50%. In general, the latching stop bar voltage may be reduced up to about by at least about 10%, more preferable at least about 20%, and sometimes about 25%-33%.

In some examples, a portion of the voltage applied to the anchor bar and/or on-glass components may be redirected from the anchor bar and/or on-glass components to the latching bar (e.g., in steps S1210 and S1212).

This may result in at least some nominal savings in terms of operational costs and battery usage. However, because "pole swapping" and charge build-ups can occur as discussed above, these otherwise apparently nominal savings can become quite large, as less energy is required to mitigate the switching and build-ups (especially when boosting transformers such as flyback transformers or the like are not implemented).

Figure 13:
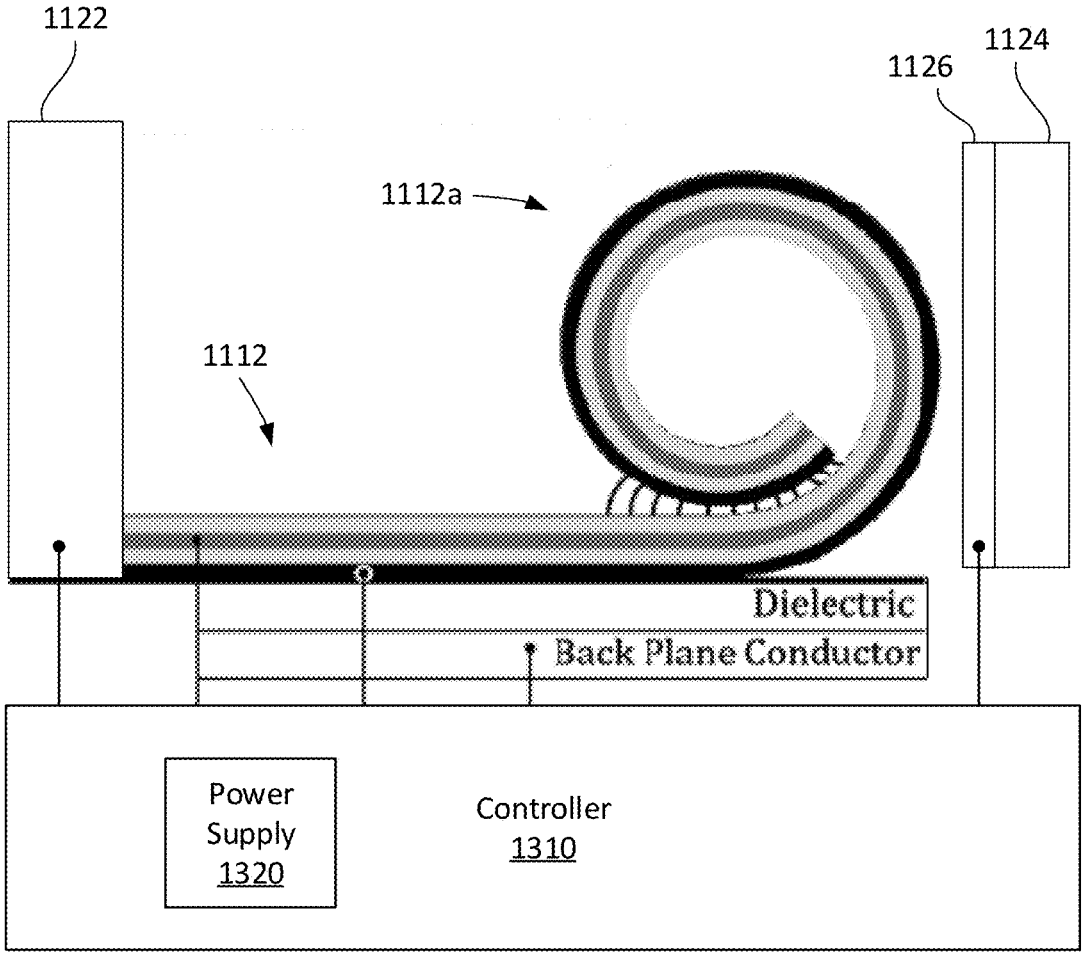
FIG. 13 is a schematic view of an example system for controlling operation of a shutter including a latching stop bar, according to certain example embodiments.

FIG. 13 is a schematic view of an example system for controlling operation of a shutter 1112 including a latching stop bar 1124, according to certain example embodiments. The example system shown in FIG. 13 includes a controller 1310 including circuitry configured to apply voltage to the on-glass components of the shade 112, anchor bar 1122, and/or latching stop bar 1124. In certain example embodiments, the control circuit 1310 may be configured to provide voltages to the on-glass components of the shade 112, anchor bar 1122 and/or latching stop bar 1124 in accordance with one or more operations discussed with reference to the flowchart shown in FIG. 12.

The controller 1310 is coupled to the on-glass components of the shade 112, anchor bar 1122, and/or latching stop bar 1124. The controller may include a power supply 1320 and/or may be coupled to an external power supply. The power supply 1320 may include an AC and/or DC power supply (e.g., a DC battery and/or an AC supply for charging the DC battery). The controller 1310 is configured to independently apply voltages to the on-glass components of the shade 112, anchor bar 1122 and/or latching stop bar 1124 supplied by the power supply 1320 and independently control discharge of the voltage applied to the on-glass components of the shutter 1112, anchor bar 1122 and/or latching stop bar 1124.

Figure 14:
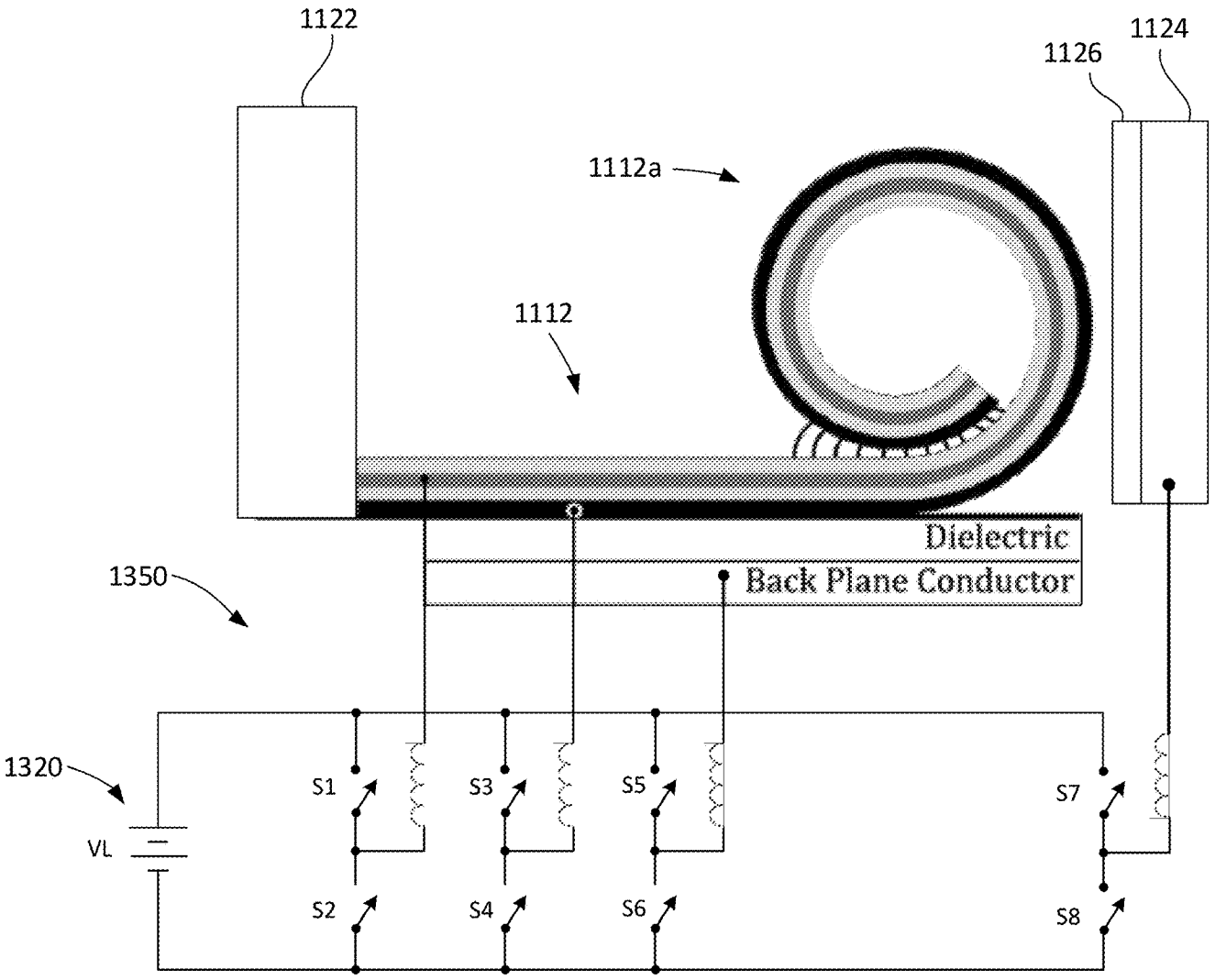
FIG. 14 illustrates an example control circuit that may be part of a controller usable in connection with FIG. 13, according to certain example embodiments.

FIG. 14 illustrates an example control circuit 1350 that may be part of the controller 1310 and used in connection with FIG. 13, according to certain example embodiments. As shown in FIG. 14, voltage from the power supply 1320 is provided to different electrodes by controlling a pair of switches coupled between the respective electrode and the power supply 1320. An inductor may be connected in series between the switches and the electrode to enable energy recovery during discharge.

As shown in FIG. 14, a first pair of switches S1 and S2 are controlled to provide voltage to a first conductive layer of the shutter 1112, a second pair of switches S3 and S4 are controlled to provide voltage to a second conductive layer of the shutter 1112, a third pair of switches S5 and S6 are controlled to provide voltage to a conductor of the on-glass components 1104, and a fourth pair of switches S7 and S8 are controlled to provide voltage to the latching stop bar 1124. In certain example embodiments, a multi-phase bridge circuit including low-cost gate driver technology can utilized to provide voltages to the different electrodes.

In certain example embodiments, the first pair of switches S1 and S2 and the second pair of switches S3 and S4 may be controlled to provide a voltage to a conducting layer in the shutter 1112 and a conductive layer in the on-glass components 1104. Providing the voltage to the conductive layers may create an electrostatic force to drive a flexible substrate of the shutter 1112 towards a closed position. Switches S7 and S8 may be controlled to provide a voltage to a conductive portion of the latching stop bar 1124. Providing the voltage to the conductive portion of the latching stop bar 1124 may create an electrostatic forces to help electrostatically latch a flexible substrate of the shutter 1112 to the latching stop bar 1124.

Although not shown in FIG. 14, in certain example embodiments, an additional pair of switches and an inductor may be included in the control circuit 1350 to separately provide a voltage to the anchor bar 1122.

The control circuit 1350 allows for independent control of the charge and discharge provided to the different electrodes of the dynamic shade. The switches may be controlled to reduce the voltages applied to the anchor bar, window, and stop bar, and to reapply the voltage to the latching stop bar or other component of the dynamic shade.

As discussed above with reference to the flowchart in FIG. 12, in certain example embodiments, the voltage output to the different electrodes may be reduced and added back (e.g., see steps S1210 and S1212). The control circuit 1350 allows for independent control of the charge and discharge provided to the different electrodes of the dynamic shade. The switches may be controlled to reduce the voltages applied to the anchor bar, window and stop bar and to reapply the voltage to the latching stop bar or other component of the dynamic shade.

In certain example embodiments, the voltage output to the electrodes can be reduced by appropriate restriction of the current. Appropriate pulse width modulation (PWM) waveforms may be used in certain example embodiments. In this regard, PWM generally requires voltage and/or current measurement to provide feedback signals in a control loop. It will be appreciated that the precise duty cycle and duration can be determined by those skilled in the art. Reducing and reapplying the voltage is not so limited and may be performed by other techniques known to those skilled in the art, for example, by controlling the voltage provided by the power supply 1320.

Although the description provided above alludes to separate and independently controllable electrode design, any suitable circuit design may be used in connection with different example embodiments. Certain example embodiments may, for example, use a circuit design that is the same as or similar to that used in connection with the techniques described above related to powered retraction of the shutter. For example, there may be provided an additional half-bridge output that drives the latching stop bar electrode. The circuit may be a multi-phase (e.g., a three-phase) push-pull circuit. If a latching stop bar and powered retraction were to be implemented in the same design, the circuit may be modified to include an additional half-bridge output stage (e.g., a fourth half-bridge output stage). In certain example embodiments, the controller may include a pair of H-bridge circuit for controlling the charging and discharging.

Although certain example embodiments are described in connection with an electrostatic latching stop bar, the use of the term "bar" should not be understood to denote any specific structure. The shape of the "stop" may be generally elongate in certain example embodiments. In different example embodiments, however, a stop may comprise multiple stop segments. The shape of the stop as a whole may be generally rectangular in certain example embodiments; however, different shapes may be used in different example embodiments. For instance, as will be appreciated from the description above, a receiving portion may be defined on a surface of the stop facing the anchor bar from which the shutter extends, and this receiving portion may be flat, generally semicircular, etc. In a similar vein as that discussed above, although the term "bar" is used in connection with the term "anchor bar," it will be appreciated the use of the word "bar" here does not denote any specific shape for the anchor generally.

The IG units described herein may incorporate low-E coatings on any one or more of surfaces 1, 2, 3, and 4. As noted above, for example, such low-E coatings may serve as the conductive layers for shades. In other example embodiments, in addition to or apart from serving and conductive layers for shades, a low-E coating may be provided on another interior surface. For instance, a low-E coating may be provided on surface 2, and a shade may be provided with respect to surface 3. In another example, the location of the shade and the low-E coating may be reversed. In either case, a separate low-E coating may or may not be used to help operate the shade provided with respect to surface three. In certain example embodiments, the low-E coatings provided on surfaces 2 and 3 may be silver-based low-E coatings. Example low-E coatings are set forth in U.S. Pat. Nos. 9,802,860; 8,557,391; 7,998,320; 7,771,830; 7,198,851; 7,189,458; 7,056,588; and 6,887,575; the entire contents of each of which is hereby incorporated by reference. Low-E coatings based on ITO and/or the like may be used for interior surfaces and/or exterior surfaces. See, for example, U.S. Pat. Nos. 9,695,085 and 9,670,092; the entire contents of each of which is hereby incorporated by reference. These low-E coatings may be used in connection with certain example embodiments.

Antireflective coatings may be provided on major surfaces of the IG unit, as well. In certain example embodiments, an AR coating may be provided on each major surface on which a low-E coating and shade is not provided. Example AR coatings are described in, for example, U.S. Pat. Nos. 9,796,619 and 8,668,990 as well as U.S. Publication No. 2014/0272314; the entire contents of each of which is hereby incorporated by reference. See also U.S. Pat. No. 9,556,066, the entire contents of which is hereby incorporated by reference herein. These AR coatings may be used in connection with certain example embodiments.

The example embodiments described herein may be incorporated into a wide variety of applications including, for example, interior and exterior windows for commercial and/or residential application, skylights, doors, merchandizers such as refrigerators/freezers (e.g., for the doors and/or "walls" thereof), vehicle applications, etc.

Although certain example embodiments have been described in connection with IG units including two substrates, it will be appreciated that the techniques described herein may be applied with respect to so-called triple-IG units. In such units, first, second, and third substantially parallel spaced apart substrates are separated by first and second spacer systems, and shades may be provided adjacent to any one or more of the interior surfaces of the innermost and outermost substrates, and/or to one or both of the surfaces of the middle substrate.

Although certain example embodiments have been described as incorporating glass substrates (e.g., for use of the inner and outer panes of the IG units described herein), it will be appreciated that other example embodiments may incorporate a non-glass substrate for one or both of such panes. Plastics, composite materials, and/or the like may be used, for example. When glass substrates are used, such substrates may be heat treated (e.g., heat strengthened and/or thermally tempered), chemically tempered, left in the annealed state, etc. In certain example embodiments, the inner or outer substrate may be laminated to another substrate of the same or different material.

As used herein, the terms "on," "supported by," and the like should not be interpreted to mean that two elements are directly adjacent to one another unless explicitly stated. In other words, a first layer may be said to be "on" or "supported by" a second layer, even if there are one or more layers therebetween.

In certain example embodiments, an insulating glass (IG) unit is provided. First and second substrates each have interior and exterior major surfaces, the interior major surface of the first substrate facing the interior major surface of the second substrate. A spacer system helps to maintain the first and second substrates in substantially parallel spaced apart relation to one another and to define a gap therebetween. An anchor and a stop are provided, with at least a portion of the stop being electrically conductive. A dynamically controllable shade is interposed between the first and second substrates. The shade includes a first conductive layer provided, directly or indirectly, on the interior major surface of the first substrate; a first dielectric layer provided, directly or indirectly, on the first conductive layer on a side thereof opposite the first substrate; and a shutter including a flexible substrate supporting a second conductive layer, the shutter being extendible from the anchor towards the stop to a shutter closed position and being retractable from the stop towards the anchor to a shutter open position. A second dielectric layer is provided, directly or indirectly, on an anchor-facing surface of the stop. A control circuit is configured to provide: a first voltage to the first and second conductive layers to create first electrostatic forces to drive the flexible substrate to the shutter closed position; and a second voltage to the electrically conductive portion of the stop to create second electrostatic forces to help electrostatically latch the flexible substrate to the stop.

In addition to the features of the previous paragraph, in certain example embodiments, the stop may be an aluminum extrusion, a brass shim, and/or the like.

In addition to the features of either of the two previous paragraphs, in certain example embodiments, the second dielectric layer may comprise polyimide.

In addition to the features of any of the three previous paragraphs, in certain example embodiments, the first conductive layer may form a part of a first electrode, the second conductive layer may form a part of a second electrode, and the electrically conductive portion of the stop may form a part of a third electrode, e.g., with the third electrode being electrically isolated from and controllable independent of the first and second conductive layers.

In addition to the features of any of the four previous paragraphs, in certain example embodiments, the anchor-facing surface of the stop may be shaped to receive an end portion of the shade when the shade is extended to the shutter closed position.

In addition to the features of the previous paragraph, in certain example embodiments, the end portion of the shade may be roll-like when the shade is extended to the shutter closed position, and the anchor-facing surface of the stop may include a curve for receiving the roll-like end portion of the shade.

In addition to the features of any of the six previous paragraphs, in certain example embodiments, the control circuit may be further configured to provide a third voltage to the first conductive layer when the shutter is held in the shutter closed position, e.g., with the third voltage being lower than the first voltage.

In addition to the features of the previous paragraph, in certain example embodiments, the control circuit may be further configured to provide a fourth voltage to the electrically conductive portion of the stop when the shutter is held in the shutter closed position, e.g., with the fourth voltage being lower than the second voltage.

In addition to the features of the previous paragraph, in certain example embodiments, the fourth voltage may be higher than the third voltage.

In addition to the features of any of the nine previous paragraphs, in certain example embodiments, the first and second voltages may be the same.

In addition to the features of any of the 10 previous paragraphs, in certain example embodiments, the control circuit may include a first half-bridge circuit coupled between the first conductive layer and a power source, a second half-bridge circuit coupled between the second conductive layer and the power source, and a third half-bridge circuit coupled between the electrically conductive portion of the stop and the power source.

In addition to the features of the previous paragraph, in certain example embodiments, the first and second half-bridge circuits may be controlled to provide the first voltage, and the third half-bridge circuit may be controlled to provide the second voltage.

In addition to the features of any of the 12 previous paragraphs, in certain example embodiments, the control circuit may be configured to provide the second voltage to the electrically conductive portion of the stop after the first electrostatic forces to drive the flexible substrate to the shutter closed position is created based on the first voltage.

In certain example embodiments, there is provided a method of operating a dynamic shade in an insulating glass (IG) unit according to any of the 13 previous paragraphs. The first voltage is provided to the first and second conductive layers to drive the flexible substrate to the shutter closed position. The second voltage is provided to the electrically conductive portion of the stop to help electrostatically latch the flexible substrate to the stop. The flexible substrate is caused to return to the shutter open position.

In addition to the features of the previous paragraph, in certain example embodiments, a third voltage may be provided to the first conductive layer when the shutter is held in the shutter closed position, e.g., with the third voltage being lower than the first voltage.

In addition to the features of the previous paragraph, in certain example embodiments, a fourth voltage may be provided to the electrically conductive portion of the stop when the shutter is held in the shutter closed position, e.g., with the fourth voltage being lower than the second voltage.

In addition to the features of the previous paragraph, in certain example embodiments, the fourth voltage may be higher than the third voltage.

In addition to the features of either of the two previous paragraphs, in certain example embodiments, the first and second voltages may be the same.

In addition to the features of any of the five previous paragraphs, in certain example embodiments, the stop may be an aluminum extrusion or a brass shim.

In addition to the features of any of the six previous paragraphs, in certain example embodiments, the first conductive layer may form a part of a first electrode, the second conductive layer may form a part of a second electrode, and the electrically conductive portion of the stop may form a part of a third electrode, e.g., with the third electrode being electrically isolated from and controllable independent of the first and second conductive layers.

In addition to the features of any of the seven previous paragraphs, in certain example embodiments, the anchor-facing surface of the stop may be shaped to receive an end portion of the shade when the shade is extended to the shutter closed position.

In certain example embodiments, there is provided a substrate comprising an anchor and a stop, at least a portion of the stop being electrically conductive. A dynamically controllable shade is provided thereon, the shade including: a first conductive layer provided, directly or indirectly, on the substrate; a first dielectric layer provided, directly or indirectly, on the first conductive layer on a side thereof opposite the substrate; and a shutter including a flexible substrate supporting a second conductive layer, the shutter being extendible from the anchor towards the stop to a shutter closed position and being retractable from the stop towards the anchor to a shutter open position. A second dielectric layer is provided, directly or indirectly, on an anchor-facing surface of the stop. The first and second conductive layer and the conductive portion of the stop are all connectable to a control circuit configured to provide: a first voltage to the first and second conductive layers to create first electrostatic forces to drive the flexible substrate to the shutter closed position; and a second voltage to the electrically conductive portion of the stop to create second electrostatic forces to help electrostatically latch the flexible substrate to the stop.

In addition to the features of the previous paragraph, in certain example embodiments, the anchor-facing surface of the stop may be shaped to receive an end portion of the shade when the shade is extended to the shutter closed position.

In addition to the features of the previous paragraph, in certain example embodiments, the end portion of the shade may be roll-like when the shade is extended to the shutter closed position, and the anchor-facing surface of the stop may include a curve for receiving the roll-like end portion of the shade.

In addition to the features of any of the three previous paragraphs, in certain example embodiments, a third voltage may be providable to the first conductive layer when the shutter is held in the shutter closed position, e.g., with the third voltage being lower than the first voltage; and a fourth voltage may be providable to the electrically conductive portion of the stop when the shutter is held in the shutter closed position, e.g., with the fourth voltage being lower than the second voltage and higher than the third voltage.

In addition to the features of any of the four previous paragraphs, in certain example embodiments, the control circuit may include a first half-bridge circuit coupled between the first conductive layer and a power source, a second half-bridge circuit coupled between the second conductive layer and the power source, and a third half-bridge circuit coupled between the electrically conductive portion of the stop and the power source, wherein the first and second half-bridge circuits may be controlled to provide the first voltage, and the third half-bridge circuit may be controlled to provide the second voltage.

In certain example embodiments, a method of making an insulating glass (IG) unit is provided. The method comprises having first and second substrates, each having interior and exterior major surfaces, the interior major surface of the first substrate facing the interior major surface of the second substrate. An anchor and a stop are provided. At least a portion of the stop is electrically conductive. A second dielectric layer is provided, directly or indirectly, on an anchor-facing surface of the stop. A dynamically controllable shade is provided on the first and/or second substrate, the shade including: a first conductive layer provided, directly or indirectly, on the interior major surface of the first substrate; a first dielectric layer provided, directly or indirectly, on the first conductive layer on a side thereof opposite the first substrate; and a shutter including a flexible substrate supporting a second conductive layer, the shutter being extendible from the anchor towards the stop to a shutter closed position and being retractable from the stop towards the anchor to a shutter open position. The first and second conductive layer and the conductive portion of the stop are connected to a control circuit that is configured to provide (a) a first voltage to the first and second conductive layers to create first electrostatic forces to drive the flexible substrate to the shutter closed position, and (b) a second voltage to the electrically conductive portion of the stop to create second electrostatic forces to help electrostatically latch the flexible substrate to the stop. The first and second substrates are connected to one another in substantially parallel, spaced apart relation, such that a gap is defined therebetween and such that the dynamically controllable shade is located in the gap.

In addition to the features of the previous paragraph, in certain example embodiments, the anchor-facing surface of the stop may be shaped to receive an end portion of the shade when the shade is extended to the shutter closed position.

In addition to the features of either of the two previous paragraphs, in certain example embodiments, the end portion of the shade may be roll-like when the shade is extended to the shutter closed position, and the anchor-facing surface of the stop may include a curve for receiving the roll-like end portion of the shade.

In addition to the features of any of the three previous paragraphs, in certain example embodiments, a third voltage may be providable to the first conductive layer when the shutter is held in the shutter closed position, e.g., with the third voltage being lower than the first voltage; and a fourth voltage may be providable to the electrically conductive portion of the stop when the shutter is held in the shutter closed position, e.g., with the fourth voltage being lower than the second voltage and higher than the third voltage.

While the invention has been described in connection with what is presently considered to be the most practical and preferred embodiment, it is to be understood that the invention is not to be limited to the disclosed embodiment and/or deposition techniques, but on the contrary, is intended to cover various modifications and equivalent arrangements included within the spirit and scope of the appended claims.

What is claimed is:

1. An insulating glass (IG) unit, comprising:

first and second substrates, each having interior and exterior major surfaces, the interior major surface of the first substrate facing the interior major surface of the second substrate;

a spacer system helping to maintain the first and second substrates in substantially parallel spaced apart relation to one another and to define a gap therebetween;

an anchor and a stop, at least a portion of the stop being electrically conductive;

a dynamically controllable shade interposed between the first and second substrates, the shade including:

a first conductive layer provided, directly or indirectly, on the interior major surface of the first substrate;

a first dielectric layer provided, directly or indirectly, on the first conductive layer on a side thereof opposite the first substrate; and a shutter including a flexible substrate supporting a second conductive layer, the shutter being extendible from the anchor towards the stop to a shutter closed position and being retractable from the stop towards the anchor to a shutter open position;

a second dielectric layer provided, directly or indirectly, on an anchor-facing surface of the stop; and a control circuit configured to provide:

a first voltage to the first and second conductive layers to create first electrostatic forces to drive the flexible substrate to the shutter closed position; and a second voltage to the electrically conductive portion of the stop to create second electrostatic forces to help electrostatically latch the flexible substrate to the stop.

2. The IG unit of claim 1, wherein the stop is an aluminum extrusion.

3. The IG unit of claim 1, wherein the stop is a brass shim.

4. The IG unit of claim 2, wherein the second dielectric layer comprises polyimide.

5. The IG unit of claim 1, wherein the first conductive layer forms a part of a first electrode, the second conductive layer forms a part of a second electrode, and the electrically conductive portion of the stop forms a part of a third electrode, the third electrode being electrically isolated from and controllable independent of the first and second conductive layers.

6. The IG unit of claim 1, wherein the anchor-facing surface of the stop is shaped to receive an end portion of the shade when the shade is extended to the shutter closed position.

7. The IG unit of claim 6, wherein the end portion of the shade is roll-like when the shade is extended to the shutter closed position, and wherein the anchor-facing surface of the stop includes a curve for receiving the roll-like end portion of the shade.

8. The IG unit of claim 1, wherein the control circuit is further configured to provide a third voltage to the first conductive layer when the shutter is held in the shutter closed position, the third voltage being lower than the first voltage.

9. The IG unit of claim 8, wherein the control circuit is further configured to provide a fourth voltage to the electrically conductive portion of the stop when the shutter is held in the shutter closed position, the fourth voltage being lower than the second voltage.

10. The IG unit of claim 9, wherein the fourth voltage is higher than the third voltage.

11. The IG unit of claim 9, wherein the first and second voltages are the same.

12. The IG unit of claim 1, wherein the control circuit includes a first half-bridge circuit coupled between the first conductive layer and a power source, a second half-bridge circuit coupled between the second conductive layer and the power source, and a third half-bridge circuit coupled between the electrically conductive portion of the stop and the power source.

13. The IG unit of claim 12, wherein the first and second half-bridge circuits are controlled to provide the first voltage, and the third half-bridge circuit is controlled to provide the second voltage.

14. The IG unit of claim 1, wherein the control circuit is configured to provide the second voltage to the electrically conductive portion of the stop after the first electrostatic forces to drive the flexible substrate to the shutter closed position is created based on the first voltage.

15. A method of operating a dynamic shade in an insulating glass (IG) unit, the method comprising:

having the IG unit of claim 1;

providing the first voltage to the first and second conductive layers to drive the flexible substrate to the shutter closed position;

providing the second voltage to the electrically conductive portion of the stop to help electrostatically latch the flexible substrate to the stop; and causing the flexible substrate to return to the shutter open position.

16. The method of claim 15, further comprising provide a third voltage to the first conductive layer when the shutter is held in the shutter closed position, the third voltage being lower than the first voltage.

17. The method of claim 16, further comprising providing a fourth voltage to the electrically conductive portion of the stop when the shutter is held in the shutter closed position, the fourth voltage being lower than the second voltage.

18. The method of claim 17, wherein the fourth voltage is higher than the third voltage.

19. The method of claim 17, wherein the first and second voltages are the same.

20. The method of claim 15, wherein the stop is an aluminum extrusion or a brass shim.

21. The method of claim 15, wherein the first conductive layer forms a part of a first electrode, the second conductive layer forms a part of a second electrode, and the electrically conductive portion of the stop forms a part of a third electrode, the third electrode being electrically isolated from and controllable independent of the first and second conductive layers.

22. The method of claim 15, wherein the anchor-facing surface of the stop is shaped to receive an end portion of the shade when the shade is extended to the shutter closed position.

23. A substrate, comprising:

an anchor and a stop, at least a portion of the stop being electrically conductive; and a dynamically controllable shade provided thereon, the shade including:

a first conductive layer provided, directly or indirectly, on the substrate;

a first dielectric layer provided, directly or indirectly, on the first conductive layer on a side thereof opposite the substrate; and a shutter including a flexible substrate supporting a second conductive layer, the shutter being extendible from the anchor towards the stop to a shutter closed position and being retractable from the stop towards the anchor to a shutter open position; and a second dielectric layer provided, directly or indirectly, on an anchor-facing surface of the stop; and wherein the first and second conductive layer and the conductive portion of the stop are all connectable to a control circuit configured to provide:

a first voltage to the first and second conductive layers to create first electrostatic forces to drive the flexible substrate to the shutter closed position; and a second voltage to the electrically conductive portion of the stop to create second electrostatic forces to help electrostatically latch the flexible substrate to the stop.

24. The substrate of claim 23, wherein the anchor-facing surface of the stop is shaped to receive an end portion of the shade when the shade is extended to the shutter closed position.

25. The substrate of claim 24, wherein the end portion of the shade is roll-like when the shade is extended to the shutter closed position, and wherein the anchor-facing surface of the stop includes a curve for receiving the roll-like end portion of the shade.

26. The substrate of claim 23, wherein:

a third voltage is providable to the first conductive layer when the shutter is held in the shutter closed position, the third voltage being lower than the first voltage; and a fourth voltage is providable to the electrically conductive portion of the stop when the shutter is held in the shutter closed position, the fourth voltage being lower than the second voltage and higher than the third voltage.

27. The substrate of claim 23, wherein the control circuit includes a first half-bridge circuit coupled between the first conductive layer and a power source, a second half-bridge circuit coupled between the second conductive layer and the power source, and a third half-bridge circuit coupled between the electrically conductive portion of the stop and the power source, wherein the first and second half-bridge circuits are controlled to provide the first voltage, and the third half-bridge circuit is controlled to provide the second voltage.

28. A method of making an insulating glass (IG) unit, the method comprising:

having first and second substrates, each having interior and exterior major surfaces, the interior major surface of the first substrate facing the interior major surface of the second substrate;

providing an anchor and a stop, at least a portion of the stop being electrically conductive, and a second dielectric layer being provided, directly or indirectly, on an anchor-facing surface of the stop;

providing a dynamically controllable shade on the first and/or second substrate, the shade including:

a first conductive layer provided, directly or indirectly, on the interior major surface of the first substrate;

a first dielectric layer provided, directly or indirectly, on the first conductive layer on a side thereof opposite the first substrate; and a shutter including a flexible substrate supporting a second conductive layer, the shutter being extendible from the anchor towards the stop to a shutter closed position and being retractable from the stop towards the anchor to a shutter open position;

connecting the first and second conductive layer and the conductive portion of the stop to a control circuit that is configured to provide (a) a first voltage to the first and second conductive layers to create first electrostatic forces to drive the flexible substrate to the shutter closed position, and (b) a second voltage to the electrically conductive portion of the stop to create second electrostatic forces to help electrostatically latch the flexible substrate to the stop; and connecting the first and second substrates to one another in substantially parallel, spaced apart relation, such that a gap is defined therebetween and such that the dynamically controllable shade is located in the gap.

29. The method of claim 28, wherein the anchor-facing surface of the stop is shaped to receive an end portion of the shade when the shade is extended to the shutter closed position.

30. The method of claim 29, wherein the end portion of the shade is roll-like when the shade is extended to the shutter closed position, and wherein the anchor-facing surface of the stop includes a curve for receiving the roll-like end portion of the shade.

31. The method of claim 28, wherein:

a third voltage is providable to the first conductive layer when the shutter is held in the shutter closed position, the third voltage being lower than the first voltage;

a fourth voltage is providable to the electrically conductive portion of the stop when the shutter is held in the shutter closed position, the fourth voltage being lower than the second voltage and higher than the third voltage.

* * * * *